US008497809B1

(12) United States Patent
Herting et al.

(10) Patent No.: US 8,497,809 B1
(45) Date of Patent: Jul. 30, 2013

(54) ELECTRONICALLY SCANNED ANTENNA

(75) Inventors: Brian J. Herting, Marion, IA (US); James B. West, Cedar Rapids, IA (US); Wajih A. ElSallal, Cedar Rapids, IA (US); John C. Mather, Cedar Rapids, IA (US); Bret W. Spars, Marion, IA (US); Daniel L. Woodell, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 13/330,515

(22) Filed: Dec. 19, 2011

Related U.S. Application Data

(62) Division of application No. 12/211,703, filed on Sep. 16, 2008, now Pat. No. 8,098,207.

(51) Int. Cl.
*H01Q 13/00* (2006.01)

(52) U.S. Cl.
USPC ..... 343/776; 343/771; 343/772; 343/770

(58) Field of Classification Search
None
See application file for complete search history.

(56) References Cited

U.S. PATENT DOCUMENTS

| | | | | |
|---|---|---|---|---|
| 4,039,975 | A * | 8/1977 | Debski | 333/122 |
| 4,777,654 | A * | 10/1988 | Conti | 455/81 |
| 5,541,612 | A * | 7/1996 | Josefsson | 343/771 |
| 6,046,702 | A | 4/2000 | Curtis et al. | |
| 6,064,349 | A | 5/2000 | Robertson | |
| 6,075,494 | A | 6/2000 | Milroy | |
| 6,115,002 | A | 9/2000 | Fischer et al. | |
| 6,972,727 | B1 * | 12/2005 | West et al. | 343/771 |
| 6,977,621 | B2 * | 12/2005 | Kelly et al. | 343/771 |
| 6,995,726 | B1 | 2/2006 | West et al. | |
| 7,423,604 | B2 | 9/2008 | Nagai | |
| 8,098,207 | B1 | 1/2012 | Herting et al. | |
| 2002/0175875 | A1 * | 11/2002 | Verstraeten | 343/786 |
| 2008/0150832 | A1 * | 6/2008 | Ingram et al. | 343/893 |

OTHER PUBLICATIONS

B. N. Dan, et al., "Resonant Conductance of Inclined Slots in the Narrow wall of Rectangular Waveguide," IEEE Trans. Antenna Propagation, vol. 32. pp. 759-761. Jul. 1984.

M. W. ElSallal, et al., "Planar edge slot waveguide antenna array design using COTS EM tools,"In Antenna Applications Symposium, Monticello, IL, 2007, pp. 76-89.

R. B. Gosselin, "A Computer-Aided Approach for Designing Edge-Slot Waveguide Arrays," Antenna Application Symposium, Sep. 20, 2003.

R. B. Gosselin, et al., "Design of Resonant Edge-Slot Waveguide Array for Lightweight Rainfall Radiometer (LRR)," IEEE Proceeding of Geoscience and Remote Sensing Symposium, v.1, Jul. 21-25, 2004, pp. 509-511.

(Continued)

*Primary Examiner* — Trinh Dinh
(74) *Attorney, Agent, or Firm* — Donna P. Suchy; Daniel M. Barbieri

(57) ABSTRACT

An aperture of an antenna for a radar system comprises a first waveguide comprising a first protrusion and a second protrusion, each protrusion extending longitudinally along one side of the first waveguide. The aperture further comprises a second waveguide comprising a third protrusion and a fourth protrusion, each protrusion extending longitudinally along one side of the second waveguide. The first and third protrusions and second and fourth protrusions adjoin to form a radio frequency choke at least partially suppressing cross polarization of radio frequencies between the first and second waveguides.

5 Claims, 29 Drawing Sheets

OTHER PUBLICATIONS

P. James, "A Waveguide Array for Unmanned Airborne Vechile (UAV)," IEE International Conference on Antennas and Propagation, Apr. 17-20, 2001, pp. 810-813.

R. Kinsey, "Monopulse Stick Phased Array," Antenna Application Symposium, Sep. 20, 1995.

L. A. Kurtz, et al., "Second-Order Beams of Two-Dimensional Slot Arrays," IEEE Trans. on Antennas and Propagation, vol. 5, No. 4, Oct. 1957, pp. 356-362.

D. J. Lewis, et al., "A Single-Plane Electronically Scanned Antenna for Airborne Radar Application," pp. 366-370 in "Practical Phased-Array Antenna Systems," by Eli Brookner. Artech House. Dec. 1991.

W. H. Watson, "Resonant Slots," IEE Journal, vol. 93, Part 3A, pp. 747-777.

J. C. Young, et al., "Analysis of a Rectangular Waveguide, Edge Slot Array With Finite Wall Thickness," IEEE Trans. on Antennas and Propagation, vol. 55, No. 3, Mar. 2007, pp. 812-818.

* cited by examiner

ELECTRONICALLY SCANNED ANTENNA

CROSS-REFERENCE TO RELATED PATENT APPLICATIONS

This application is a Divisional of U.S. application Ser. No. 12/211,703, filed Sep. 16, 2008, now issued as U.S. Pat. No. 8,098,207, incorporated herein by reference in its entirety.

BACKGROUND

The present disclosure relates generally to the field of aircraft antennas.

The functionality of various radars and systems for aircraft is greatly enhanced by the use of electronic antenna beam scanning What is needed is systems or methods that can be used to realize a cost effective, high performance antenna that enables rapid beam steering agility for various radar modes. Other features and advantages will be made apparent from the present specification. The teachings disclosed extend to those embodiments which fall within the scope of the appended claims, regardless of whether they accomplish one or more of the aforementioned needs.

SUMMARY

One embodiment of the present disclosure relates to an aperture of an antenna for a radar system. The aperture comprises a first waveguide comprising a first protrusion and a second protrusion, each protrusion extending longitudinally along one side of the first waveguide. The aperture further comprises a second waveguide comprising a third protrusion and fourth protrusion, each protrusion extending longitudinally along one side of the second waveguide. The first and third protrusions adjoin and the second and fourth protrusions adjoin to form a radio frequency choke. The radio frequency choke at least partially suppresses cross polarization of radio frequencies between the first and second waveguides.

Another embodiment of the present disclosure relates to an aperture of an antenna for a radar system. The aperture comprises an array of waveguides, each waveguide comprising multiple radiation slots having an angle with respect to an edge of the waveguide and having a depth. The angle and depth of at least a portion of the multiple radiation slots for each waveguide compensate for excess feed coupling and aperture phase errors. The angle of each radiation slot is between about five and twenty five degrees and the depth of each radiation slot is between about eighty to one hundred and twenty thousandths of an inch.

Yet another embodiment of the present disclosure relates to an apparatus for electrically coupling a waveguide of an aperture to a feed manifold of an antenna for a radar system. The apparatus comprises a coupling slot receiving a signal in a direction orthogonal to the waveguide of the aperture. The apparatus further comprises a junction substantially parallel to the waveguide of the aperture. The coupling slot propagates a signal from the waveguide of the aperture to the junction, the propagated signal having the same mode in the junction as in the waveguide of the aperture. The junction comprises a notch at an upper surface for tuning a center frequency of a predetermined operating band.

Yet another embodiment of the present disclosure relates to a radar feed assembly of an antenna for a radar system. The assembly comprises a feed manifold configured to split a received radio frequency signal into multiple outputs, the feed manifold comprising multiple hybrid couplers. Each hybrid coupler is configured to split a signal received at a single input port into two signals at two output ports. The hybrid couplers have a coupling slot for adjusting the ratio of the split between the two output ports.

Yet another embodiment of the present disclosure relates to an apparatus for electrically coupling an aperture and feed manifold of an antenna for a radar system, the aperture having at least one waveguide. The apparatus comprises a first waveguide configured to receive a signal from the feed manifold in a first direction. The apparatus further comprises a second waveguide substantially parallel to the first waveguide and configured to output the signal in a second direction to the aperture, the second waveguide comprising a ridge. The apparatus further comprises a coupling slot for propagating a signal from the first waveguide to the second waveguide. The ridge of the first waveguide comprises a step to match the impedance of the second waveguide with the impedance of the first waveguide.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF THE EXEMPLARY EMBODIMENTS

Figure 1:
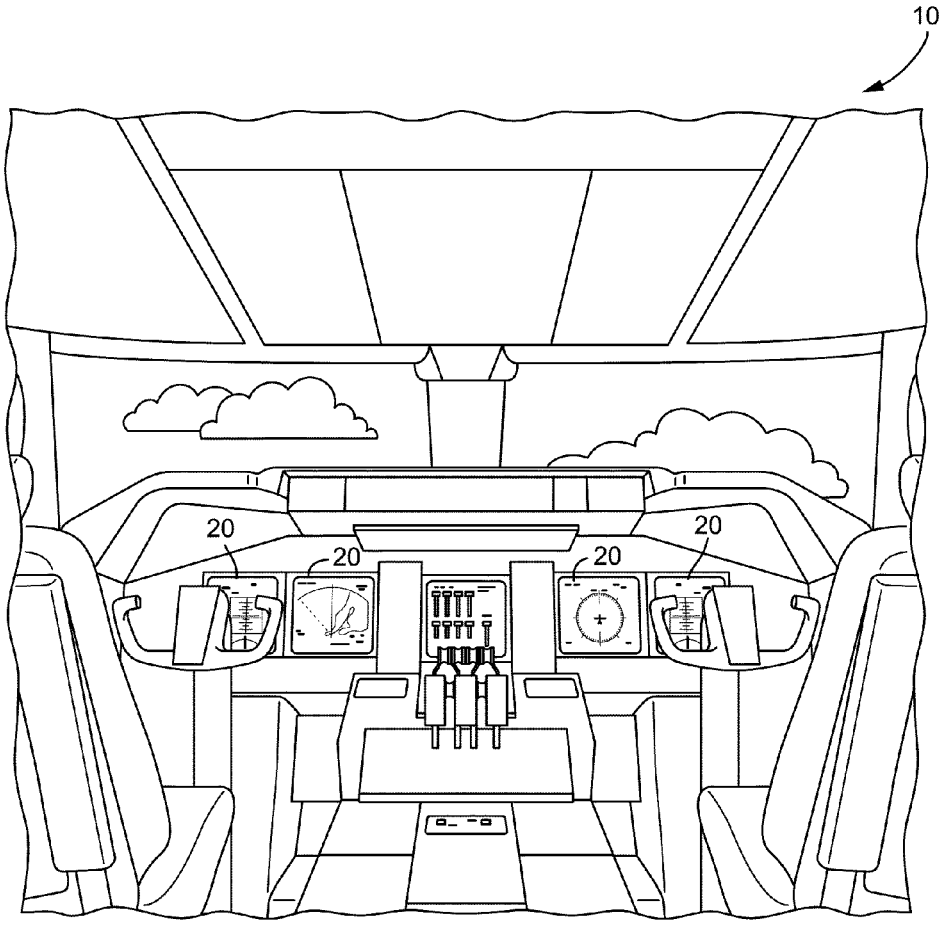
FIG. 1 is an illustration of an aircraft control center, according to an exemplary embodiment.

Before describing in detail the particular improved system and method, it should be observed that the invention includes, but is not limited to, a novel structural combination of components, and not in the particular detailed configurations thereof. Accordingly, the structure, methods, functions, control and arrangement of conventional components have, for the most part, been illustrated in the drawings by readily understandable block representations and schematic diagrams, in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

Referring generally to the figures, an antenna is disclosed that provides advantages over a current embodiment. The disclosed antenna may enable steering agility (e.g. rapid beam steering agility) for various radar modes, such as weather mapping, turbulence detection, wind sheer detection, terrain mapping, non-cooperative airborne collision avoidance, aircraft runway incursion, unmanned aerial system (UAS) seek and avoid, and other radar modes. Traditionally, low pulse repetition frequency (PRF) radar systems are limited in multi-mode operation. For example, a radar system may not be able to discern targets within less than a 3 dB beamwidth (5-10 degrees). Using the antenna of the present disclosure, digital signal processing (DSP) based synthetic beam sharpening algorithms may be used to allow for finer resolution to determine such targets. Rapid beam scanning can greatly enhance multi-mode radar operation by moving the side lobes adjacent to the main beam of the antenna (to eliminate radar ground clutter) and by interlacing multiple radar modes concurrently using rapid beam division. Beam division multiplexing is a rapid beam movement used to track multiple targets simultaneously. The antenna further allows for a wider angle of scan, according to an exemplary embodiment.

Referring to FIG. 1, an illustration of an aircraft control center or cockpit 10 is shown, according to one exemplary embodiment. Aircraft control center 10 includes flight displays 20 which are used to increase visual range and to enhance decision-making abilities. In an exemplary embodiment, flight displays 20 may provide an output from a radar system (e.g., radar system 102 of FIG. 2) of the aircraft.

Figure 2:
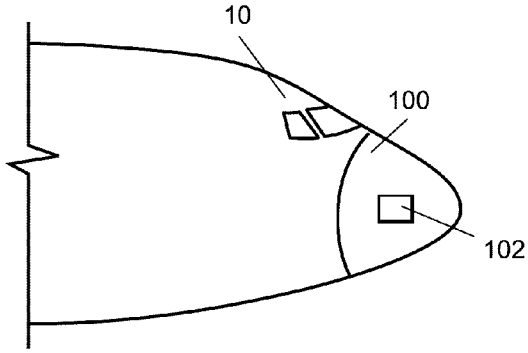
FIG. 2 is an illustration view of the nose of an aircraft including the aircraft control center of FIG. 1, according to an exemplary embodiment.

In FIG. 2, the front of an aircraft is shown with aircraft control center 10 and nose 100, according to an exemplary embodiment. A radar system 102 (e.g., a weather radar system) is generally located inside nose 100 of the aircraft or inside a cockpit of the aircraft. According to other exemplary embodiments, radar system 102 may be located on the top of the aircraft, on the tail of the aircraft, or distributed in multiple locations on the aircraft. Radar system 102 may include or be coupled to an antenna system (e.g., the antenna as described in subsequent figures).

Figure 3:
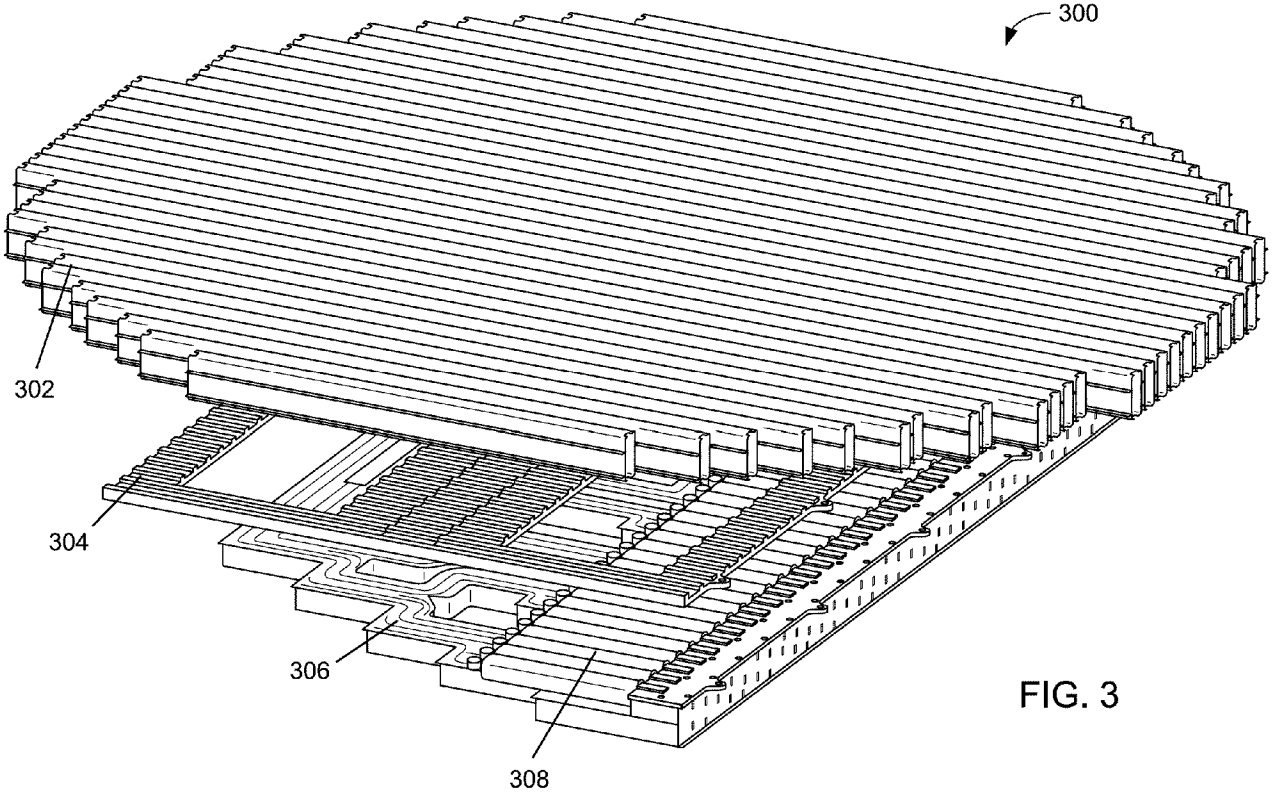
FIG. 3 is an exploded view of an antenna, according to an exemplary embodiment.
Figures 12A, 12B:
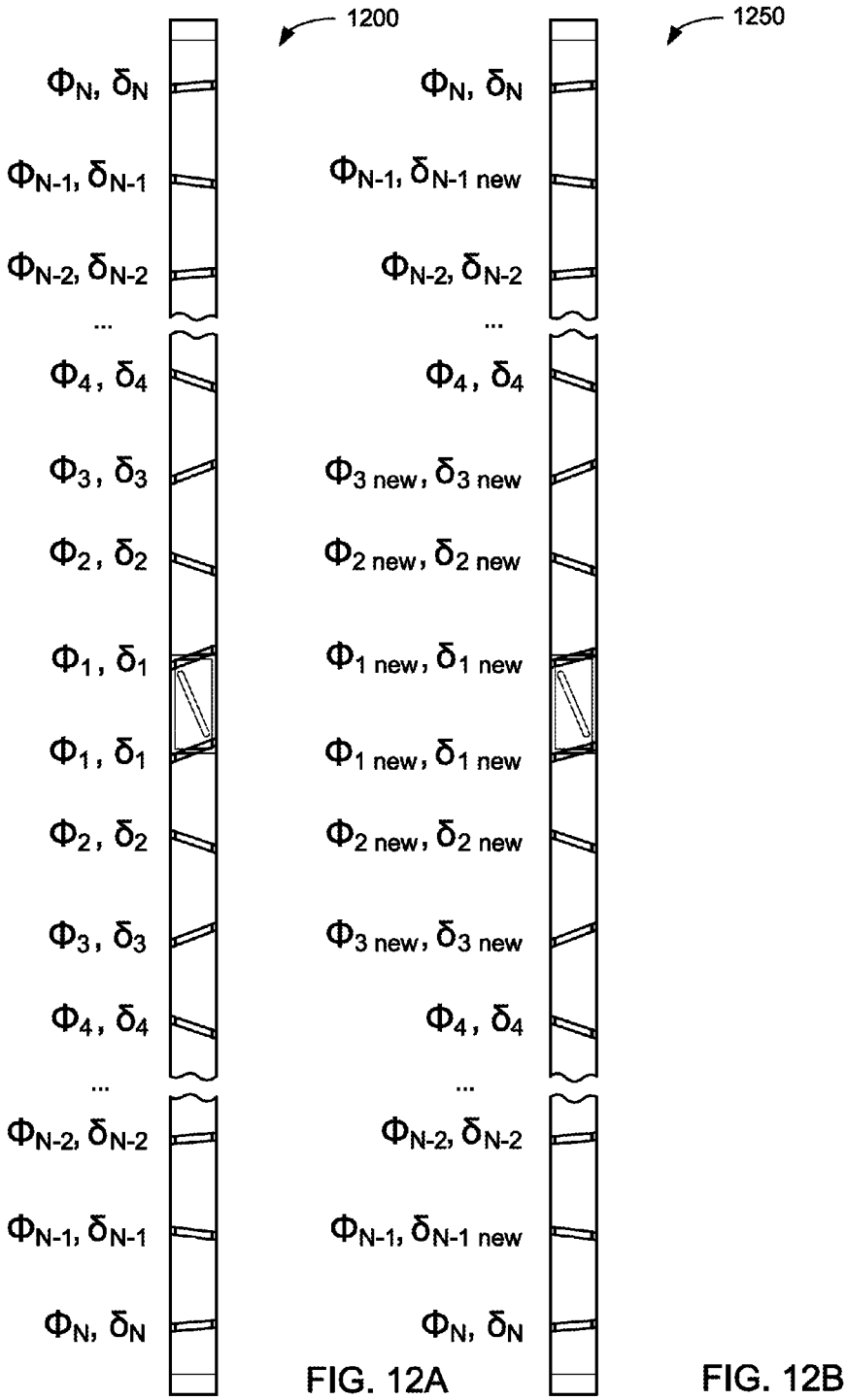
FIGS. 12A and 12B are top views of the waveguide of FIG. 6 illustrating multiple slot configurations, according to an exemplary embodiment.

Referring now to FIG. 3, an exploded view of antenna 300 and an assembly of antenna 300 that may be used in conjunction with radar system 102 is shown, according to an exemplary embodiment. According to an exemplary embodiment, antenna 300 is a one-dimensional antenna array (a planar 2D array that scans in one direction) and may be an edge slotted waveguide antenna (the waveguides of the antenna are slotted as shown in FIGS. 12A-B). Antenna 300 may be an electronically scanned antenna (ESA) capable of electronic scanning.

Figure 4:
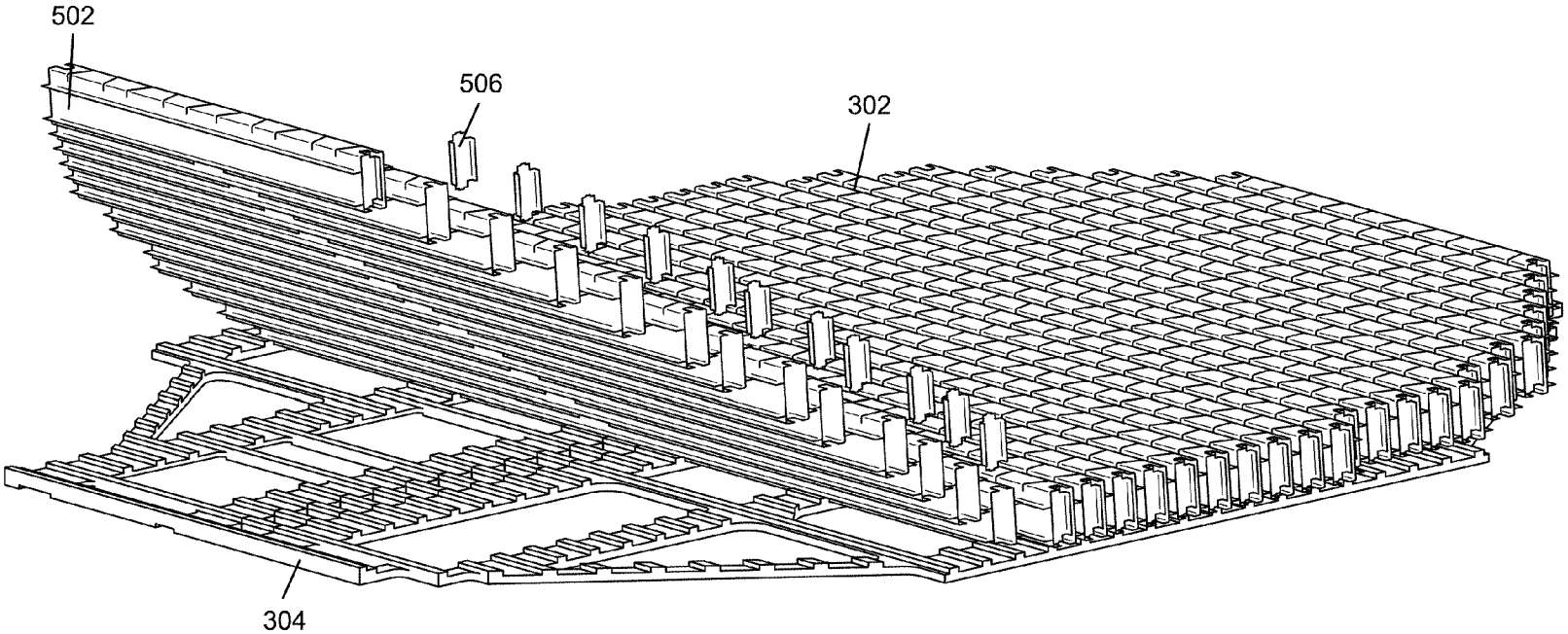
FIG. 4 is an exploded view of the assembly of the antenna of FIG. 3, according to an exemplary embodiment.
Figure 5:
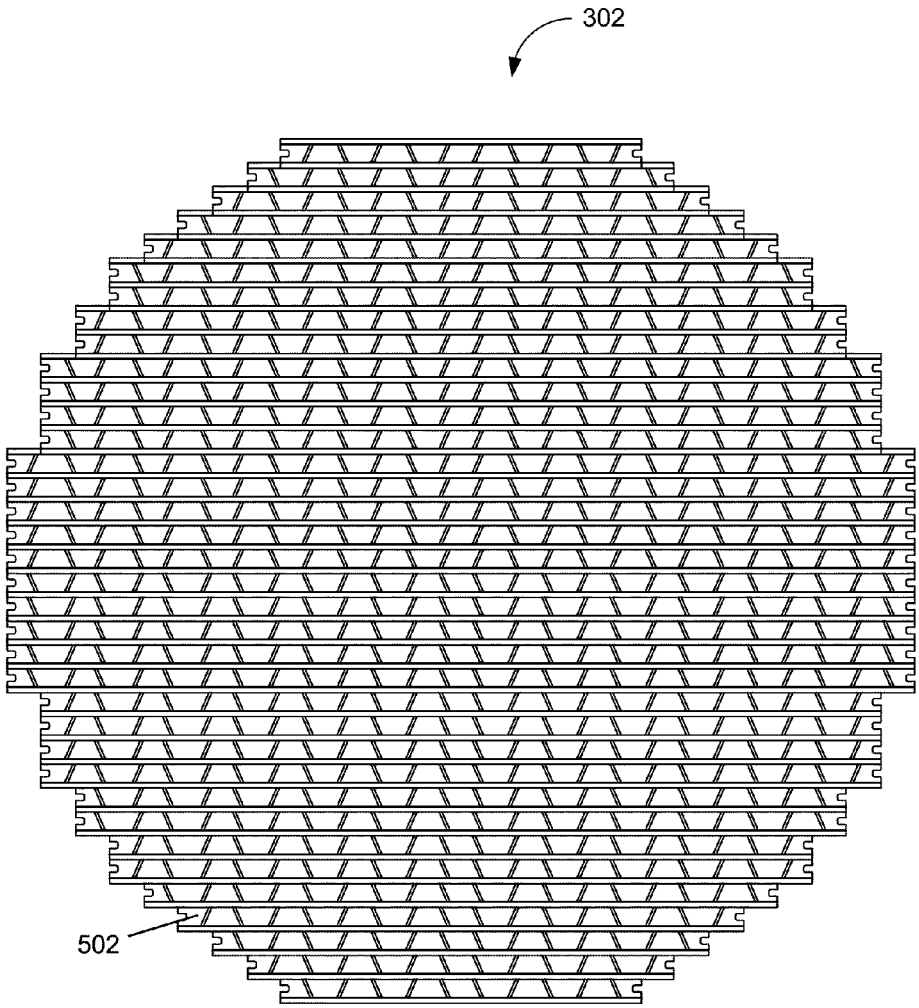
FIG. 5 is a top view of an antenna aperture of the antenna of FIG. 3, according to an exemplary embodiment.

Referring also to FIGS. 4-5, the assembly of antenna 300 includes an aperture 302 formed by an array of multiple waveguides. In the embodiment of FIG. 4, waveguides 502 of aperture 302 are shown with ends 506 (described in greater detail in FIGS. 6 and 9). FIG. 5 is a top view of an assembled aperture 302. Aperture 302 is circular, according to an exemplary embodiment, aperture 302 may alternatively be square, rectangular, elliptical, or be another shaped contour. Antenna 300 further includes a feed manifold 306 and a mounting frame 304 for coupling waveguides 302 to feed 306. Antenna 300 includes phase shifters 308. According to an exemplary embodiment, feed 306 and aperture 302 are easily separable, allowing for individual testing and repairing.

Referring generally to FIGS. 6-12, the construction and function of aperture 302 is described in greater detail.

Figure 6:
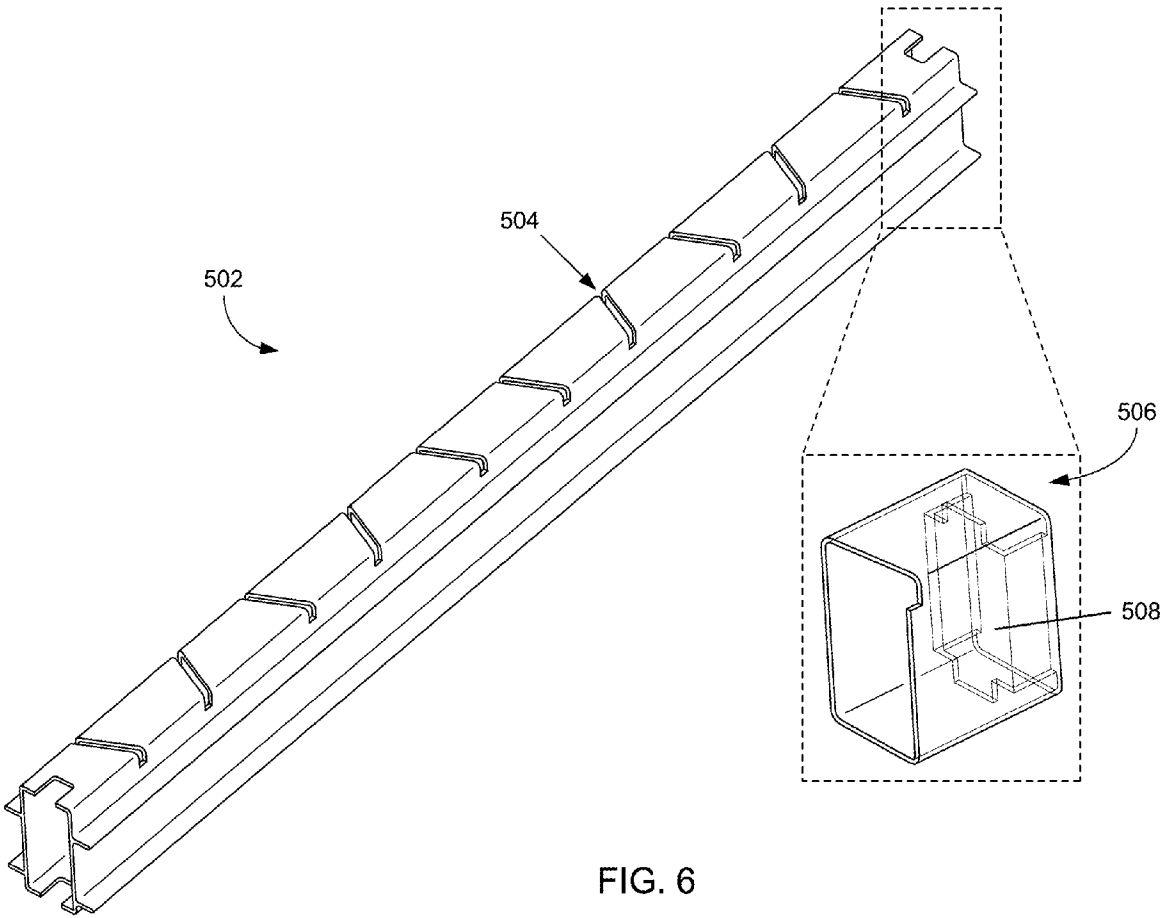
FIG. 6 is a view of a waveguide, a plurality of which form the aperture of FIG. 5, according to an exemplary embodiment.

Referring now to FIG. 6, a single waveguide (e.g., a "stick") 502 is shown, according to an exemplary embodiment. Waveguide 502 is shown with slots 504 (e.g., radiation slots). The configuration of slots 504 are shown in greater detail in FIGS. 12A-B. Waveguide 502 may include two ends 506. Ends 506 includes a short 508.

In the embodiment of FIG. 6, waveguide 502 is shown as a "standing wave" waveguide. Such waveguide feeds require a short circuit approximately one quarter waveguide wavelength away from the last radiating slot on the end of waveguide 502. End 506 is used to insert and attach short 508 to waveguide 502. End 506 and short 508 are configured to be a precise length away from the last slot 504 of waveguide 502, allowing for a proper standing wave within waveguide 502 for proper waveguide slot excitation.

Each waveguide (or "stick") has a high directivity (narrow beam) along its respective waveguide axis (the E-plane or side of waveguide 502) and a broadbeam in its orthogonal axis (the H-plane or "top" of waveguide 502). The length of the waveguides provides the high directivity along the waveguide axis. The narrow width of the waveguides provides the broadbeam along the orthogonal axis. The waveguide is a first order waveguide with a high length to width aspect ratio, according to an exemplary embodiment.

Figure 7:
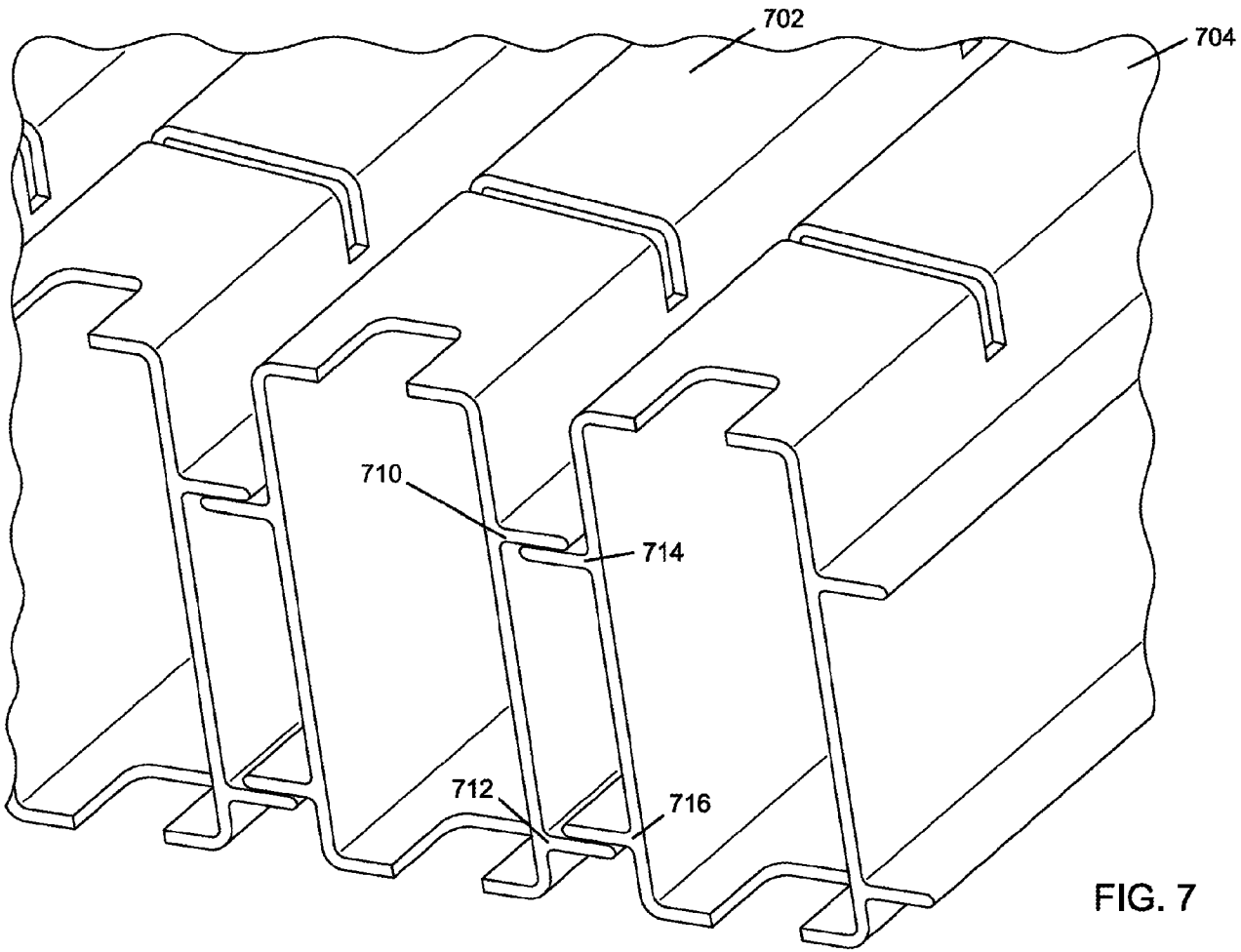
FIG. 7 is a view of a choke construction formed by multiple waveguides of FIG. 6, according to an exemplary embodiment.
Figure 8:
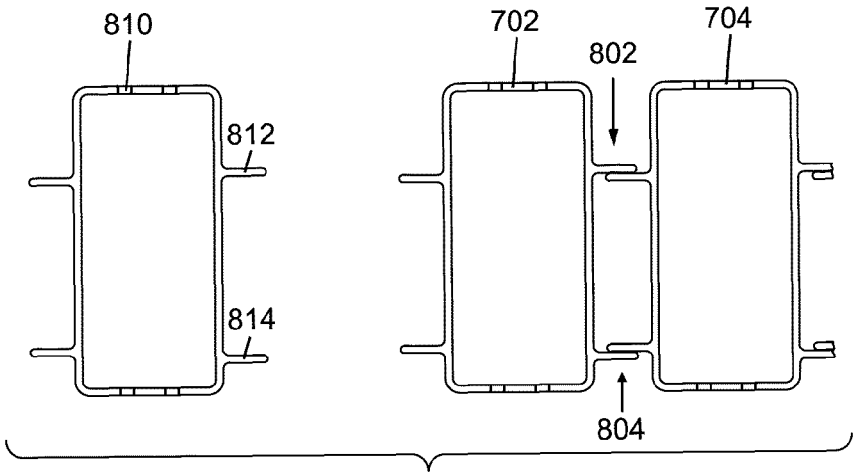
FIG. 8 is a cross section view of the choke construction of FIG. 7, according to an exemplary embodiment.
Figure 9:
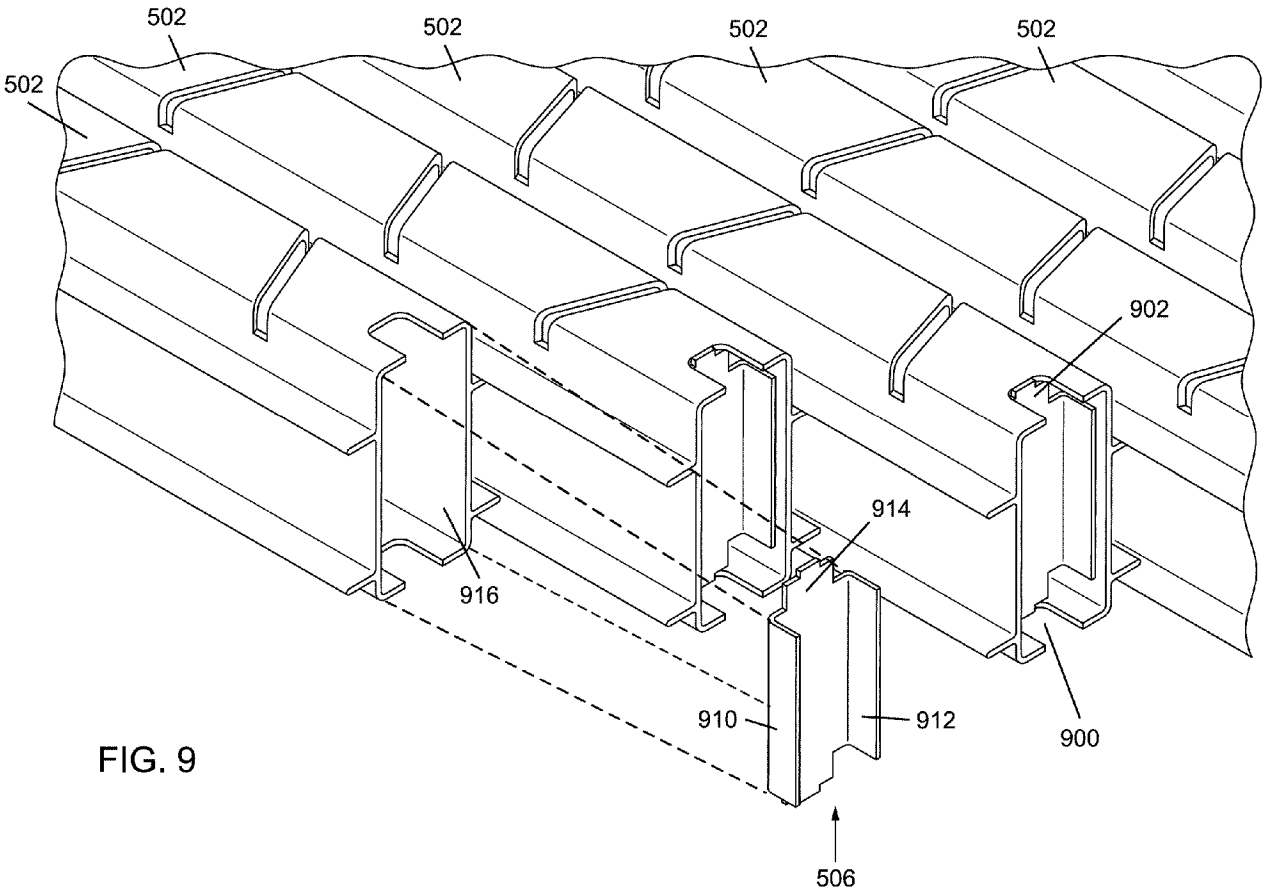
FIG. 9 is a view of the choke construction of FIG. 7 and an end piece of the waveguide, according to an exemplary embodiment.

Referring now to FIGS. 7-9, the assembly of multiple waveguides to form an aperture 302 is shown, according to an exemplary embodiment. Referring to FIGS. 7-8, waveguides 702, 704 are shown coupled together to form a choke construction. The choke may be configured to operate over a wide scan area, according to an exemplary embodiment. Waveguide 702 is shown with a first protrusion 710 and a second protrusion 712, while waveguide 704 is shown with a third protrusion 714 and a fourth protrusion 716. Protrusions 710-716 extend longitudinally from waveguides 702, 704, according to an exemplary embodiment. First protrusion 710 and third protrusion 714 adjoin to form choke 802 and second protrusion 712 and fourth protrusion 716 adjoin to form choke 804, forming a choke (e.g. a radio frequency choke) between waveguides 702 and 704. Protrusions 710-716 are integrally formed from waveguides 602 or 604, according to an exemplary embodiment. The protrusions align the slots of waveguides 702, 704 in the same plane. The choke may be electronically designed for optimization. The choke may be self fixturing (by "snapping" together protrusions 710 and 714 and protrusions 712 and 716) and may maintain a high dimensional accuracy.

Waveguides 702, 704 additionally include protrusions 720, 722, 724, 726 extending longitudinally on the opposite side of the waveguide from protrusions 710-716. Protrusions 720-726 are used to adjoin to protrusions from other waveguides of similar construction of waveguides 702, 704 of the aperture. For example, in the embodiment of FIG. 8, waveguide 810 with protrusions 812, 814 may adjoin to waveguide 702. Additional waveguides 810 are modular and have at least a similar construction to waveguides 702, 704. The waveguides are coupled together to form an array with a radio frequency choke between each waveguide, creating aperture 302. The subassemblies of the waveguides allow for precise waveguide to waveguide fixturing to form integrated RF chokes.

The formed choke is used to minimize or at least partially suppress a cross polarization effect between waveguides (e.g., waveguides 702, 704), according to an exemplary embodiment. The construction of chokes 802, 804 minimizes cross polarization as the antenna beam of antenna 300 is electronically scanned off boresight (the optical axis of the antenna where there is rotation). According to one exemplary embodiment, a small offset in the floor of the choke may be used to enhance the cross polarization suppression by approximately −2.0 decibels (dB).

The protrusions can align adjacent waveguides laterally and vertically. This configuration ensures that the surface of the waveguides are in the same place and simplifies fixturing for the final assembly and dip braze of the waveguide. For example, as shown in FIG. 8, the left protrusions of waveguide 704 are shown sandwiched between protrusions of adjacent waveguide 702. The dip brazing joins the protrusions and results in a relatively stiff waveguide structure. Dip brazing may be used for bonding; according to other exemplary embodiments, conductive epoxy, soldering, laser welding, or spot welding may be alternative bonding approaches.

Referring to FIG. 9, multiple waveguides 502 are shown along with a waveguide end or short 506, according to an exemplary embodiment. Waveguides 502 are shown to include notches 900, 902 that are created during machining of waveguides 502 and configured to help align end 506. Waveguides 502 are adjoined as described with reference to FIGS. 7-8 to form RF chokes.

The bent wing shape (e.g., "wings" 910, 912 and top 914) of end 506 allows for self-fixing to the ends 916 of waveguides 502 (using notches 900, 902) and for remaining in place during dip brazing assembly of the waveguides. The protrusions of waveguides 502 may be joined during dip brazing to stiffen the structure of aperture 302, according to an exemplary embodiment. Waveguides 502 may be made of thin-walled aluminum, according to an exemplary embodiment.

Notches 900, 902 may be used to receive a termination (or load) to realize a traveling wave feed configuration. The termination may be self-fixed to remain in place during dip brazing and notches 2100, 2102 may permit moisture drainage.

Figure 10:
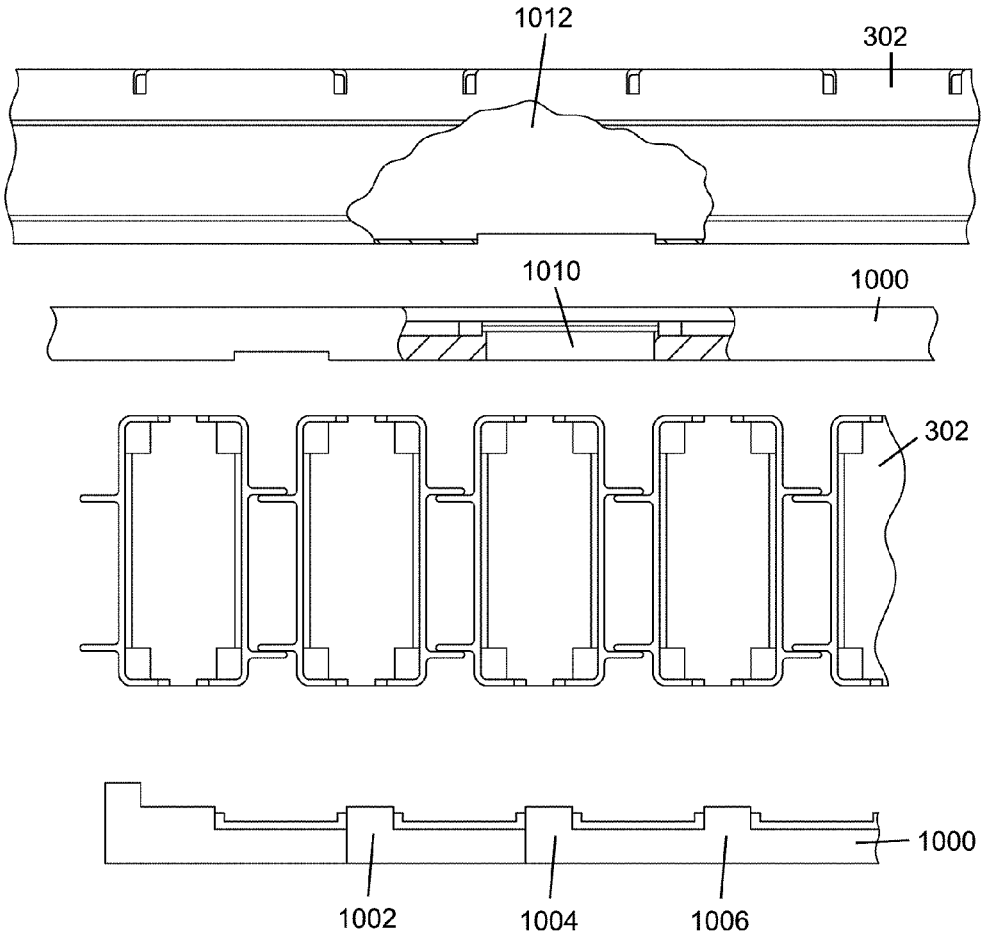
FIG. 10 is a view of the choke construction of FIG. 7 and a base plate, according to an exemplary embodiment.

Referring now to FIG. 10, formed aperture 302 is shown as part of a construction with base plate 1000, according to an exemplary embodiment (in a side view and front view). Base plate 1000 may be used to provide an accurate positioning of the individual waveguides of aperture 302 with respect to other aperture. Longitudinal grooves 1002-1006 in base plate 1000 may be used to orient and set the spacing of aperture 302. Base plate 1000 further includes bosses 1010 at the center of base plate 1000 for mating with an opening 1012 in the walls of each waveguide of aperture 302. The bosses 1010 are opposite the slots of the waveguides of aperture 302, accurately locating each waveguide along its length dimension in aperture 302.

Figure 11:
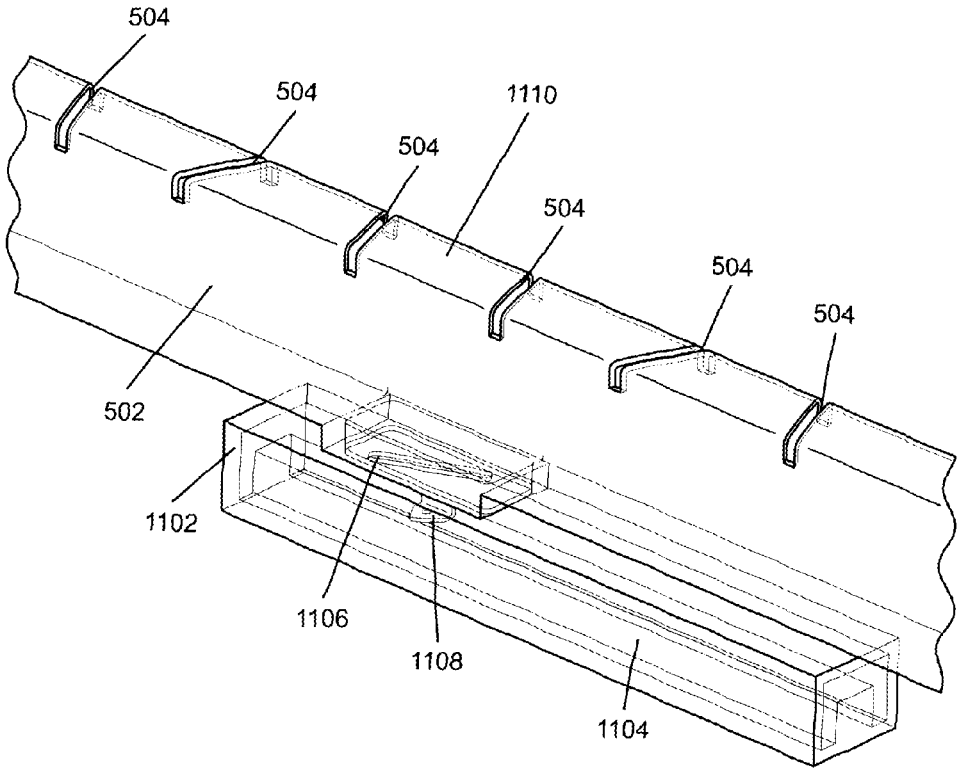
FIG. 11 is a view of an assembly between a waveguide of FIG. 6 and a junction for coupling the waveguide to a feed, according to an exemplary embodiment.

Referring to FIG. 11, a waveguide 502 to junction 1104 assembly is shown, according to an exemplary embodiment. Junction 1104 may couple to waveguide 502 and further be attached to a feed (not shown in FIG. 11). According to an exemplary embodiment, junction 1104 is a ridge waveguide coupled to the feed. In order to couple the signal (energy) from junction 1104 into slots 504 of waveguide 502, a tilted slot or coupling slot 1106 is used. Coupling slot 1106 allows the mode of the signal to be the same between the feed and waveguide 502. Coupling slot 1106 receives a signal in a direction orthogonal to waveguide 502 and propagates the signal from waveguide 502 to junction 1104. Coupling slot 1106 may be configured to control a coupling efficiency from the feed to aperture 302 via waveguides 502. According to one exemplary embodiment, coupling slot 1106 is a single slot in a coupling plate, where the coupling plate includes multiple slots located between multiple waveguides (e.g., waveguides 702, 704 of FIG. 7) of aperture 302 and multiple junctions 1104 (e.g., the coupling plate extends across multiple waveguides and junctions (not shown in FIG. 11)). Each slot 1106 is configured to couple a single waveguide 502 to a single junction 1104, according to an exemplary embodiment.

Junction 1104 is parallel to waveguide 502. Junction 1104 includes a tuning notch 1108 on its upper surface for tuning a center frequency. The center frequency may be of a predetermined operating band, according to an exemplary embodiment. Junction 1104 additionally includes a conducting wall 1102. Wall 1102 may function as an RF short for setting up the field with coupling slot 1106 to ensure proper feed to waveguide 502 coupling.

According to one exemplary embodiment, junction 1104 is attached to the center feed of each waveguide 502. According to other exemplary embodiments, waveguide 502 may be compatible with other feed transmission lines topologies (e.g., microstrip, stripline, co-planar waveguide, finline, etc.).

Referring generally to FIGS. 12A-D, a slot compensation system is illustrated. Generally speaking, the waveguide array of the aperture should avoid center feeding in order to prevent excessively high sidelobe levels (which are intolerable for most radar system applications). The slot compensation system is used to avoid center feeding, allowing for low sidelobe levels. The adjusted side lobe levels may be used to adjust the antenna to a far field region.

Each waveguide 1200, 1250 has multiple slots (e.g., radiation slots) having an angle with respect to an edge of the waveguide 1200, 1250 and having a depth. The angle and depth of at least some of the multiple slots of waveguide 1200 may be adjusted to compensate to enable low side lobe center feeding (e.g., to compensate for excess feed coupling and aperture phase errors), resulting in the adjusted slots as shown in waveguide 1250. The slot compensation system allows a desired amplitude tapering to be achieved.

With reference to FIG. 12A, waveguide 1200 has uncompensated center slots. With reference to FIG. 12B, waveguide 1250 has compensated center slots. The compensation method allows for adjustment of the angles Φ and depths 6 of the slots. According to an exemplary embodiment, the angles of the compensated slots of waveguide 1250 are less than the angles of the uncompensated slots of waveguide 1200 ($\Phi_{xnew}<\Phi_x$). Additionally, the depths of the compensated center slots are greater than the depths of the uncompensated center slots ($\delta_{xnew}>\delta_x$). Further, the depth of the next-to-last slot of waveguide 1250 is less than the next-to-last slot of waveguide 1200 ($\delta_{N-1\ new}<\delta_{N-1}$). Slots 504 of waveguides 1200, 1250 are rotated 180 degrees around the top surface of waveguide 1200, 1250 when the waveguide is center-fed. According to an exemplary embodiment, the preferred range of angles Φ of the slots 504 is between 5 and 25 degrees, and the preferred range of the depth δ of the slots is between 80 and 120 thousandths of an inch (mils).

The waveguides of the aperture may be adjusted for various ideal excitations (e.g., a Taylor synthesis, another pattern synthesis, etc.). According to one exemplary embodiment, waveguide 1250 is designed such that the co-polarized sidelobe levels are less than or equal to −30 dB with a 3 dB range or width.

According to an exemplary embodiment, the angles and depths of the slots may further be adjusted. Since there is center feeding for the waveguides, the center slots may be "corrupted" (e.g., the adjustments made as described above may cause spikes in the amplitude and phase distribution to occur). Therefore, according to an exemplary embodiment, the compensation system further optimally rolls the angles and adjusts depths of the middle three slots. Moreover, the depth δ of the slots before the last slots (towards the plunders of the aperture) are adjusted as well. These adjustments allow for a smoothing out of the amplitude and phase distribution (e.g., smoothing out the "spikes" as illustrated in graphs 1260, 1270).

Figure 12C:
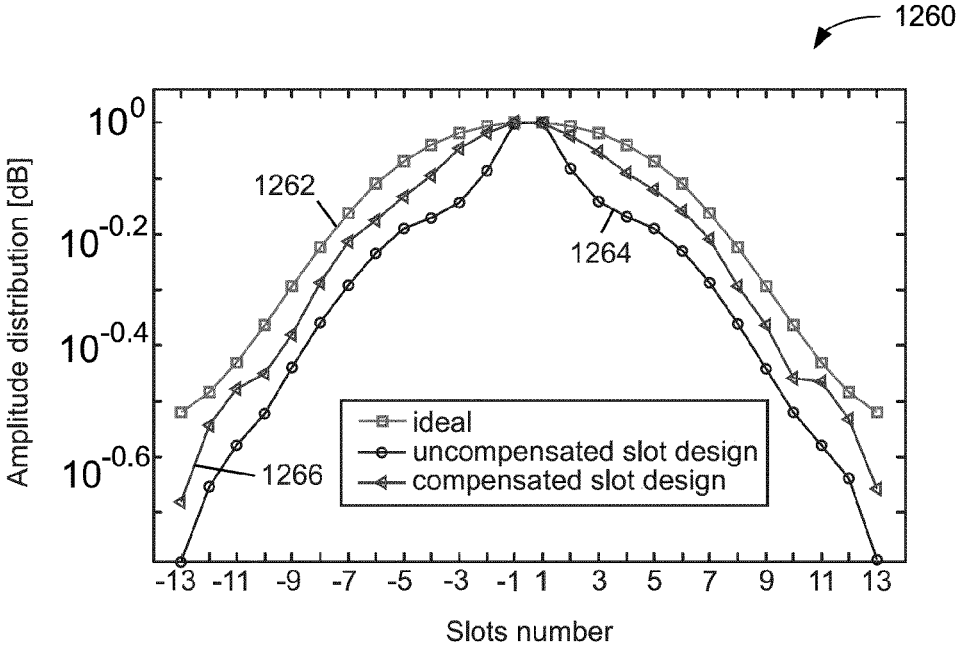
FIGS. 12C and 12D are graphs of amplitude and phase distributions associated with the slot configurations of FIGS. 12A and 12B, according to an exemplary embodiment.
Figure 12D:
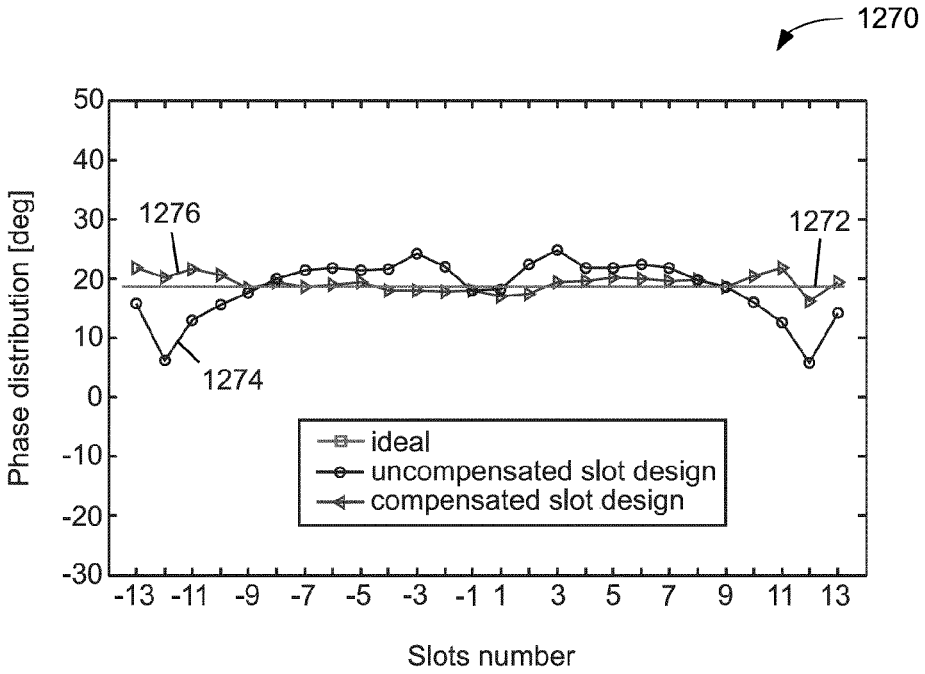

Referring to FIGS. 12C and 12D, graph 1260 illustrates an amplitude distribution associated with the slots and graph 1270 illustrates a phase distribution associated with the slots, according to an exemplary embodiment. The x axis of both graphs 1260, 1270 represent the slots of the waveguides (which correspond to slots N, N−1, N−2, . . . in FIGS. 12A and 12B). In both graphs, an "ideal" distribution 1262, 1272 is shown, and the distribution 1266, 1276 for the compensated slot configuration is shown "matching up" closer to the ideal distribution than the distribution 1264, 1274 for the uncompensated slot configuration. For the amplitude distribution shown in graph 1260, a "bell curve" shape is shown as ideal distribution 1262, indicating a desired highest amplitude distribution at the center slots of the waveguide. For the phase distribution shown in graph 1270, a flat phase is shown as ideal distribution 1272, indicating an even phase distribution across all slots of the waveguide.

An impedance matched condition may further be established for each waveguide using the slot compensation method. Usually, there may be excessive amplitude energy and phase perturbation at the centermost slots of the waveguide, which may cause distortion. The slot compensation system may adjusts the parameters of the slots (angle and depth) to help avoid such a condition.

Figure 13:
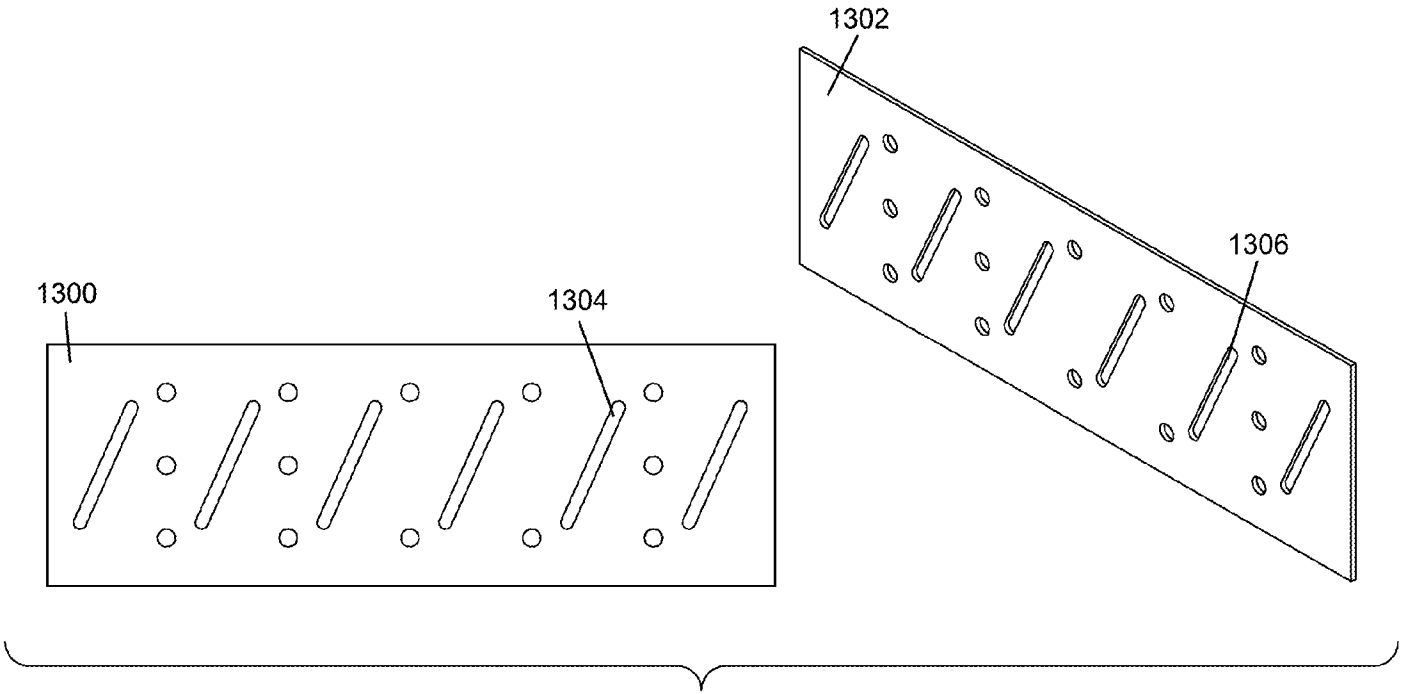
FIG. 13 is a view of slot couplers of the antenna of FIG. 3, according to an exemplary embodiment.

Referring to FIG. 13, slot couplers (or power splitters) 1300, 1302 are shown. Slot couplers 1300, 1302 may be thin sheets containing multiple slots (e.g., slot 2604, 2606) that are placed between feed 306 and aperture 302 of antenna 300. Slot couplers 1300, 1302 may be easily separated from the rest of the antenna system, according to an exemplary embodiment (allowing for an optimization of the coupling of feed 306 and aperture 302 without having to make changes to the feed or aperture assemblies). Slot couplers 1300, 1302 control the coupling efficiency from feed 306 to aperture 302, according to an exemplary embodiment. The angular orientation of the slot controls the coupling efficiency, according to an exemplary embodiment. The length of the slot helps achieve a impedance matched condition for a maximum power transfer between feed 306 and the waveguides of aperture 302.

According to an exemplary embodiment, slot couplers 1300, 1302 may be used to function as junction 1104 of FIG. 11. Slot couplers 1300, 1302 may be physically compact to reduce the thickness of the transition between feed 306 and aperture 302 such that the aperture size may be maximized. According to an exemplary embodiment, the slot couplers have a ridged waveguide to the input arm and rectangular waveguides as the side arms that form the waveguides.

Referring generally to FIGS. 14-23, the components of and a manufacturing and assembly process for antenna 300 is shown, according to an exemplary embodiment. The design of antenna 300 may include a waveguide that is a relatively thin and light aluminum structure. The various parts of antenna 300 may be self-fixtured in order to provide an accurate alignment of the parts of antenna 300.

Figure 14:
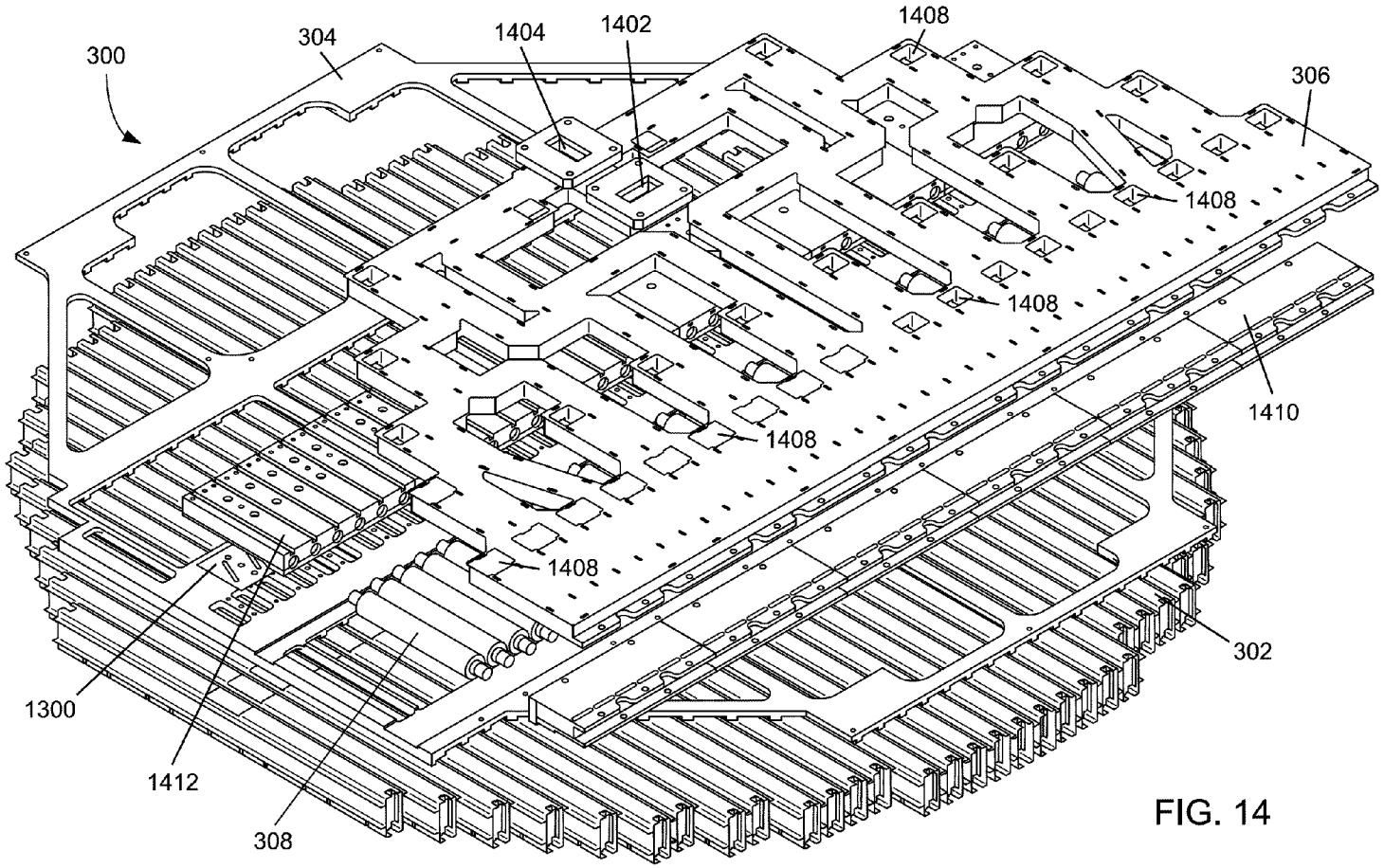
FIG. 14 is a schematic view of the assembly of the antenna of FIG. 3, according to an exemplary embodiment.

FIG. 14 is a schematic view of the assembly of antenna 300, according to an exemplary embodiment. Antenna 300 includes feed 306 with two inputs (a sigma port 1402 and delta port 1404), a transition 1410, phase shifters 308, transition 1412, slot couplers 1300, and aperture 302. Feed 306 may accept a signal input and provide an output for transition 1410. Feed 306 includes two input ports 1402, 1404 for accepting an input signal (e.g., an RF signal), and various hybrid couplers 1408 located throughout feed 306. The construction of feed 306 is shown and described in greater detail in FIGS. 15A-21.

Transition 1410 accepts the output from feed 306 and relays the output to phase shifters 308 to shift the phase of the output as needed. The output is then fed into transition 1412 for directing the output through antenna 300. The construction and function of transitions 1410, 1412 are shown in greater detail in FIGS. 22A-23. The output is then fed through slot couplers 1300 to aperture 302. Antenna 300 includes mounting frame 304 for coupling the various components of antenna 300 together.

Referring generally to FIGS. 15A-21, feed 306 is shown in greater detail. Feed 306 may have multiple functions. Feed 306 may split the input signal from the transmitter of antenna 300 for distribution to aperture 302. According to an exemplary embodiment, the input power may be split into 36 separate parts. Additionally, feed 306 may receive an input power from aperture 302 and combine the power and provide a single output to the receiver of antenna 300. Feed 306 may further create a proper amplitude taper for low side lobe level operation.

The insertion loss of feed 306 is an important consideration in the antenna as the feed losses contribute significantly to the noise figure of the receiver. Additionally, the amplitude distribution of feed 306 directly impacts the antenna pattern performance in terms of side lobes, gain, and beamwidth. An amplitude distribution should be maintained in feed 306 to achieve a desired side lobe level (SLL) performance, according to an exemplary embodiment.

Figure 15A:
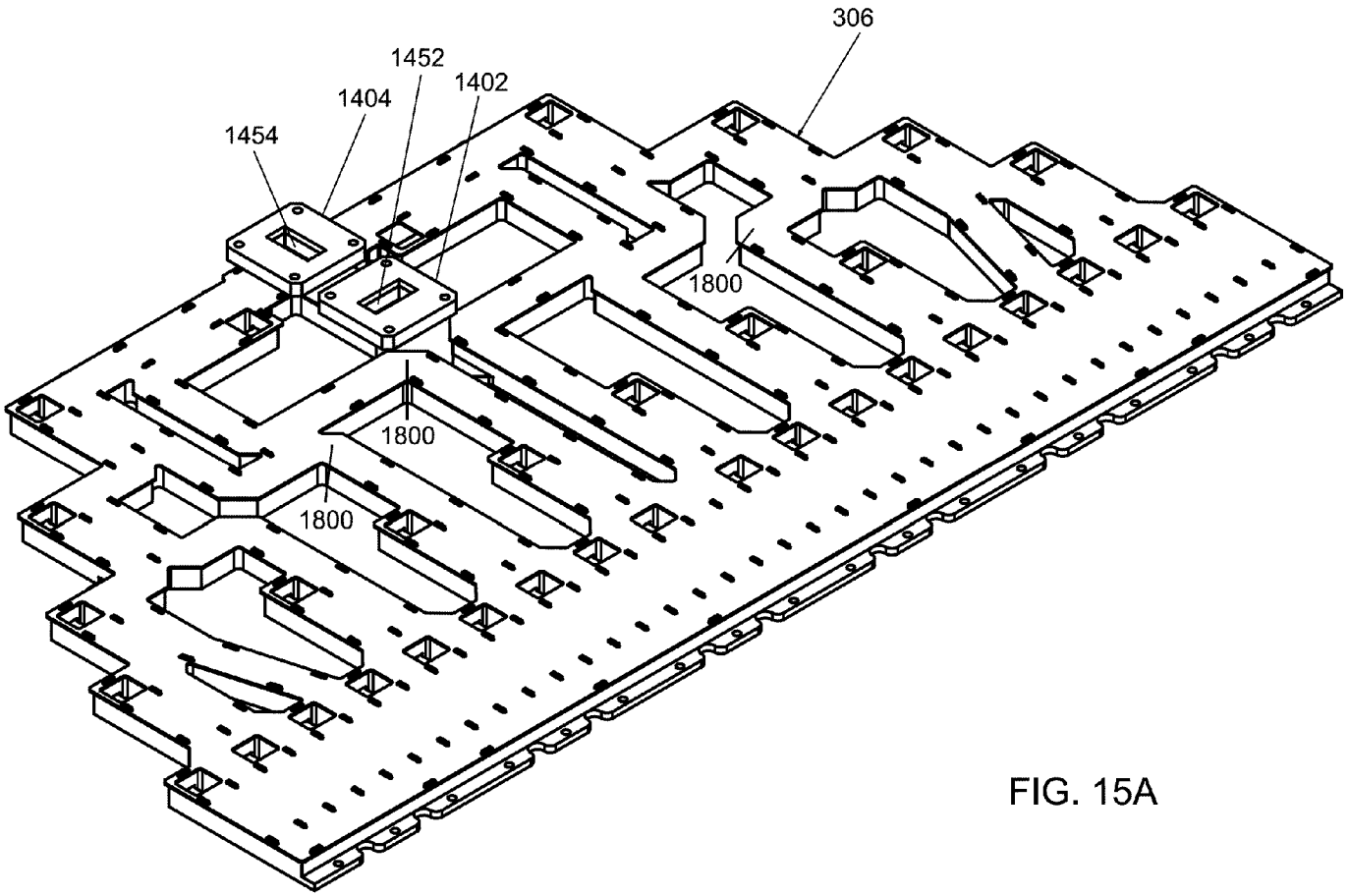
FIG. 15A is a view of the feed of the antenna of FIG. 14, according to an exemplary embodiment.

Referring to FIGS. 15A-E, an assembled feed 306 is shown. Referring specifically to FIG. 15A, feed 306 is shown with input ports 1402, 1404. Ports 1402, 1404 include slots (e.g., rectangular waveguide openings) 1452, 1454 where the input is fed into feed 306.

Figure 15B:
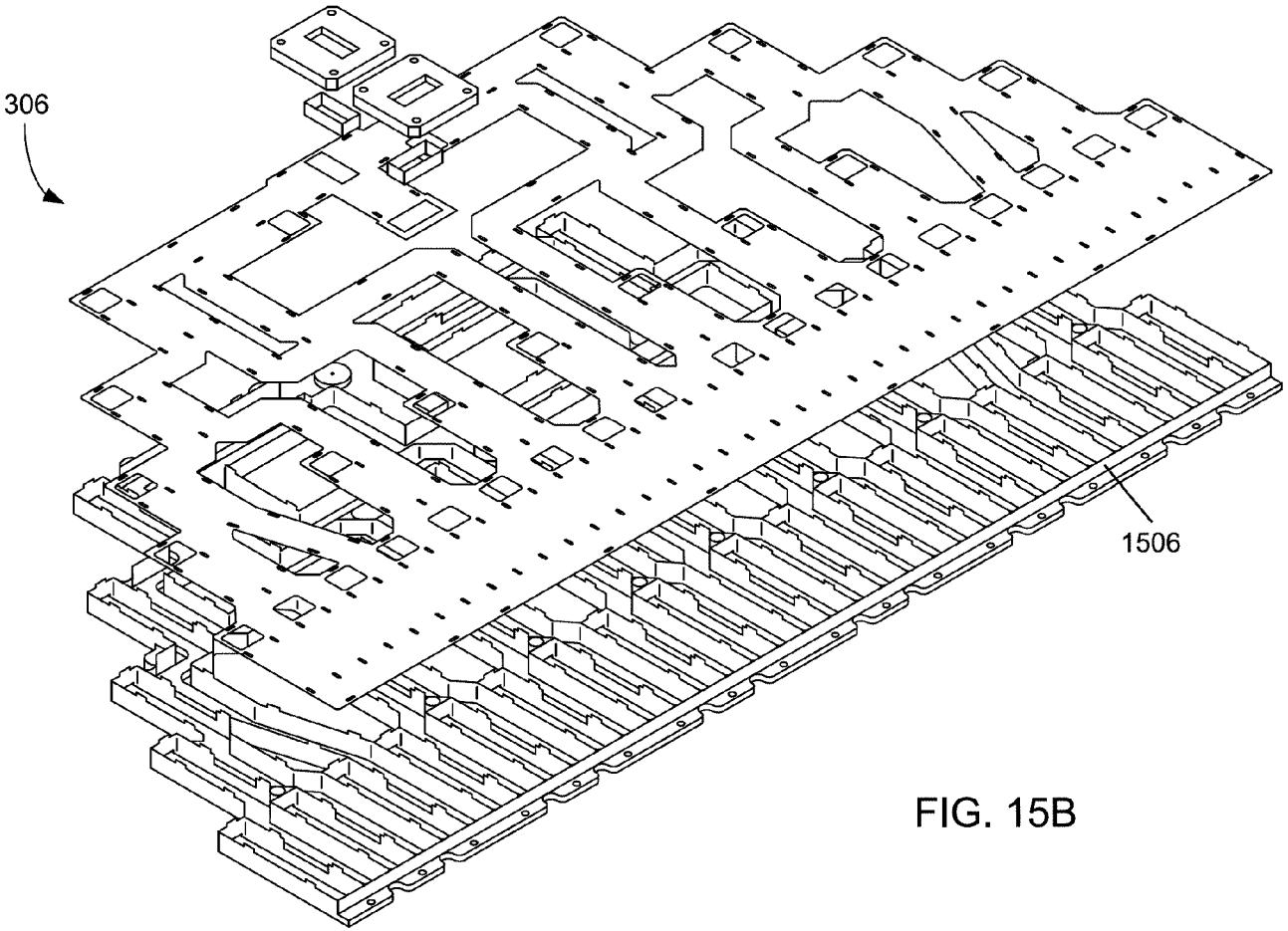
FIG. 15B is an exploded view of the feed of FIG. 15A, according to an exemplary embodiment.

Referring to FIG. 15B, an exploded view of feed 306 is shown with cover 1504 and main portion 1506. Feed 306 assembly may include two major components to assemble: a milled bottom 1506 (including the waveguide walls, ridges, and slot couplers) and a stamped lid or cover 1504.

Figure 15C:
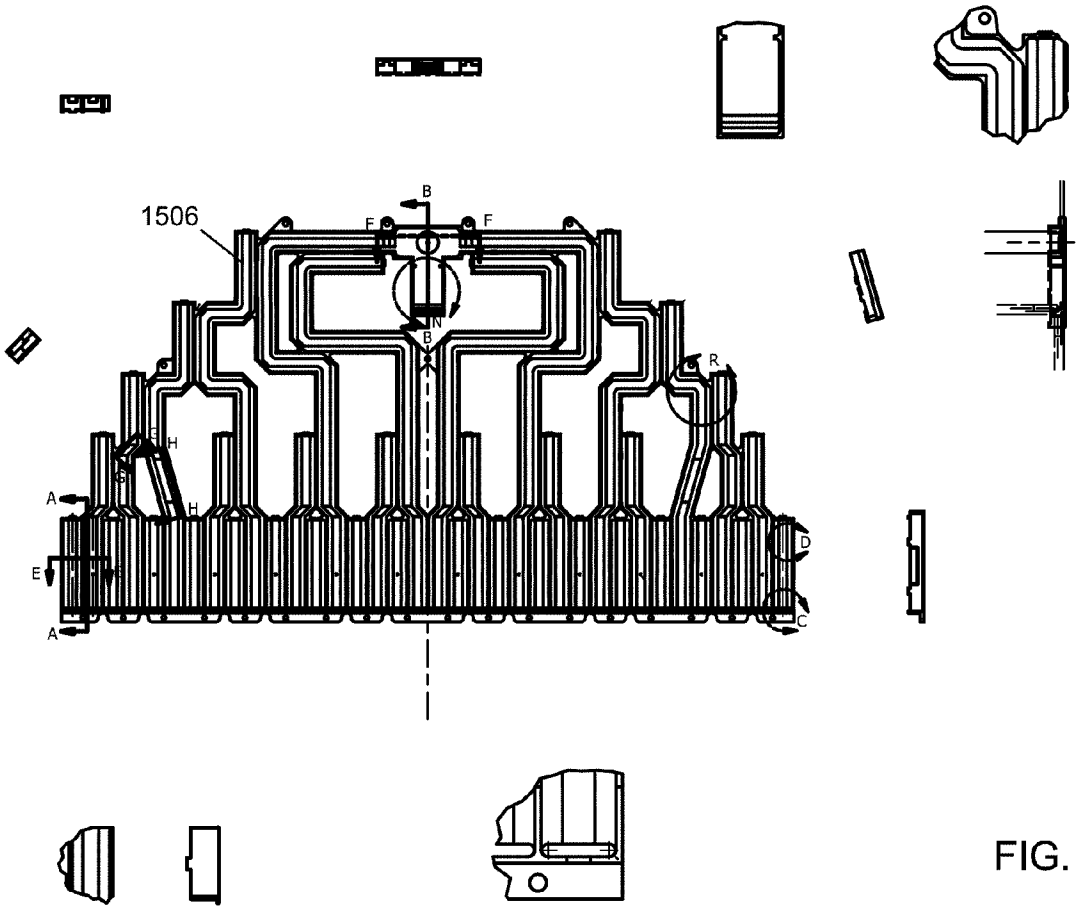
FIG. 15C is a detailed view of the feed of FIG. 15A, according to an exemplary embodiment.
Figure 15D:
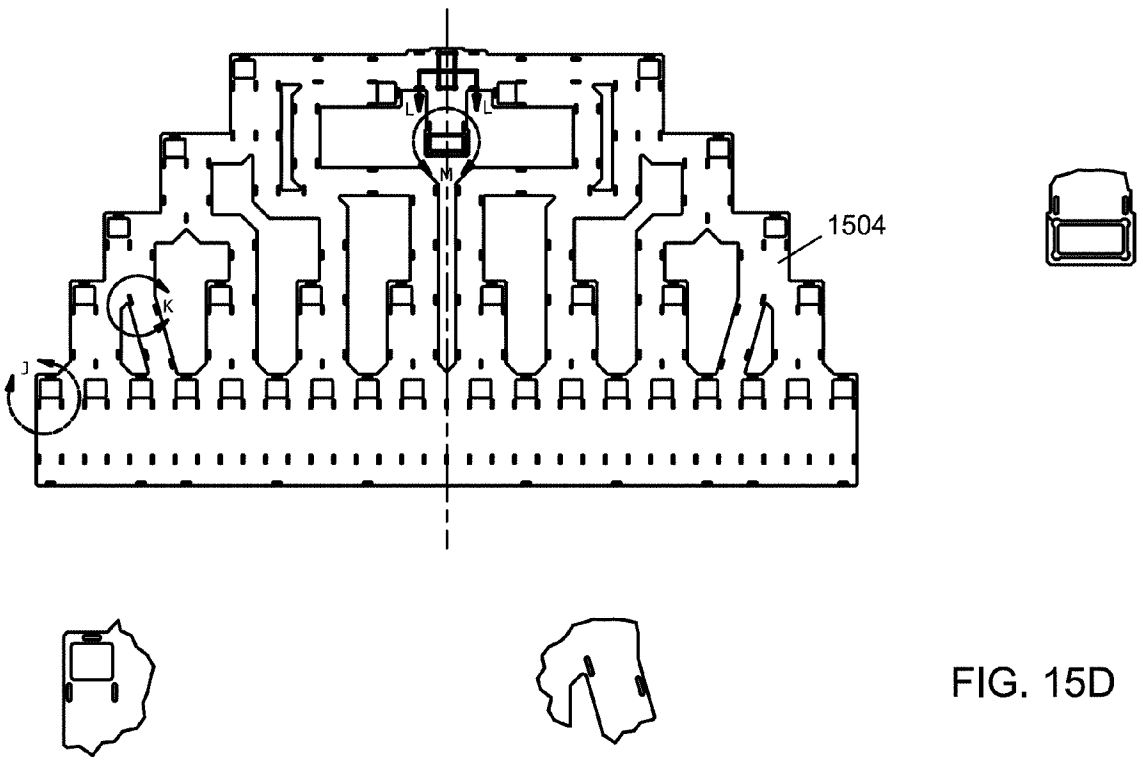
FIG. 15D is a detailed view of the cover of the feed of FIG. 15A, according to an exemplary embodiment.
Figure 15E:
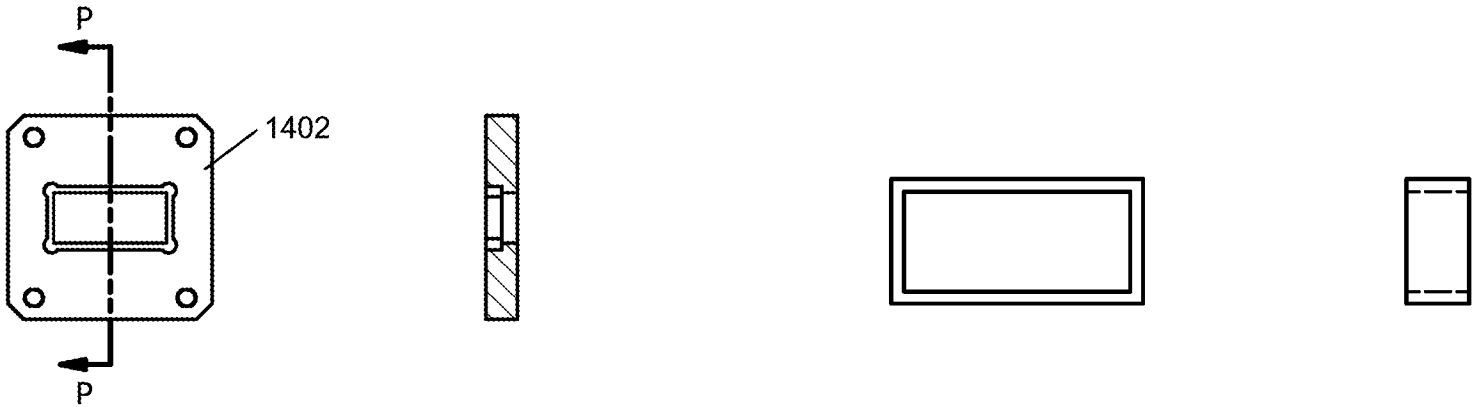
FIG. 15E is a detailed view of a slot of the feed of FIG. 15A, according to an exemplary embodiment.

Referring to FIG. 15C, the main portion 1506 of feed 306 is shown in greater detail. According to an exemplary embodiment, feed 306 may be assembled using splitters, hybrid couplers, bends, and routing structures (shown in greater detail in FIGS. 16-21). Referring to FIG. 15D, cover 1504 of feed 306 is shown in greater detail. In FIG. 15E, an input port 1402 of feed 306 is shown in greater detail.

Referring generally to FIGS. 16-20, various components are shown that may be combined to form a feed 306. Feed 306 may be assembled using multiple components configured to accept at least one input and provide at least one output to the next component or out of feed 306. For example, some components may be configured to accept a signal input and evenly split the input into two outputs. Other inputs may be split into two uneven outputs, or the component may simply not split the input and provide the output to another component.

Figure 16:
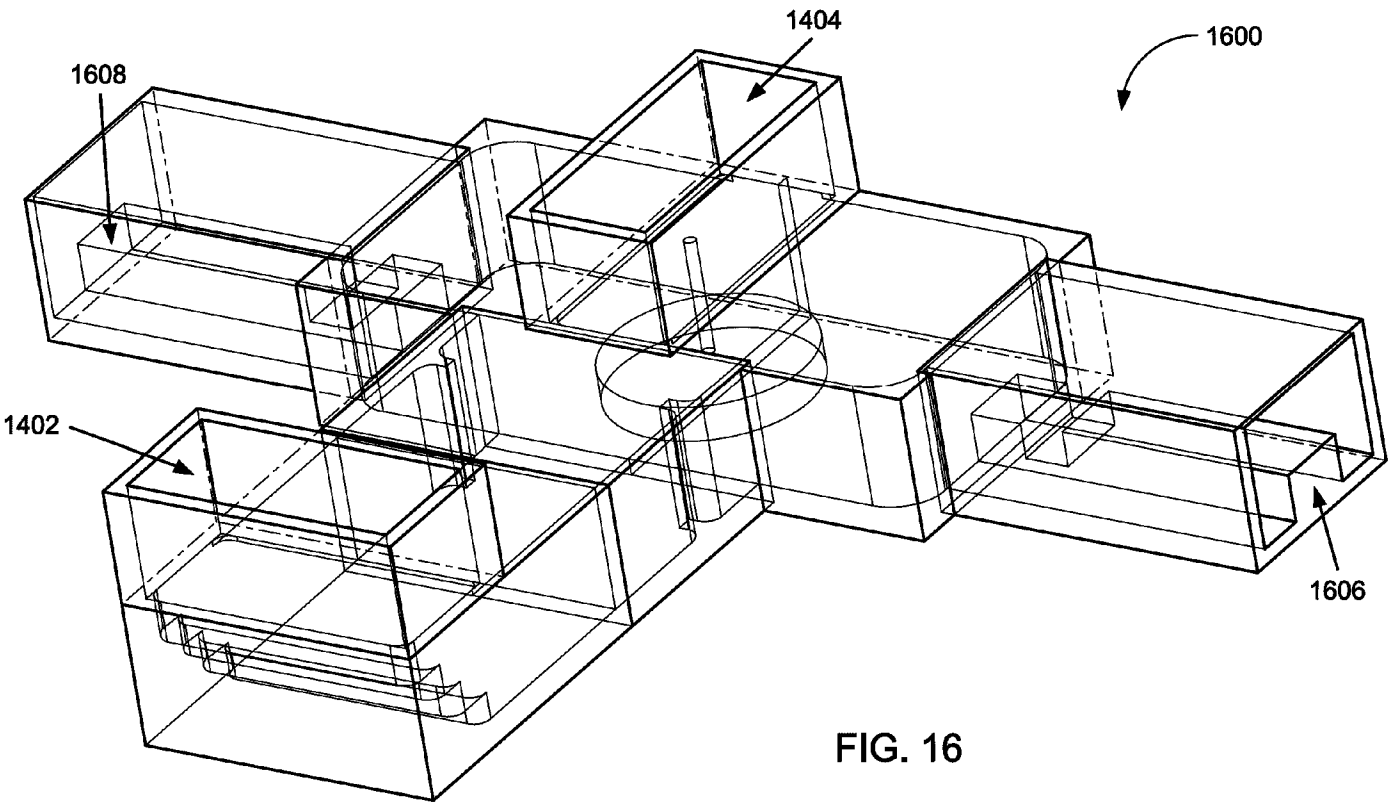
FIG. 16 is a perspective wire frame view of a splitter of the feed of FIG. 15A, according to an exemplary embodiment.

Referring to FIG. 16, a splitter or junction (e.g., a "Magic Tee") 1600 providing an input port for the receiver/transmitter is shown, according to an exemplary embodiment. Splitter 1600 consists of a sum port (or sigma port) 1402, a delta port 1404, and two output ports 1606, 1608 (e.g., ridge waveguide ports). Ports 1402, 1404 may be used as the input ports for feed 306, according to an exemplary embodiment. According to one exemplary embodiment, only one of a sum port 1402 and delta port 1404 may receive a signal (e.g., an RF signal). According to other exemplary embodiments, both sum port 1402 and delta port 1404 may receive a signal.

Splitter 1600 equally splits the power input from sum port 1402 and/or delta port 1404 to ports 1606, 1608. If only sum port 1402 accepts an input, the outputs are in phase; if only delta port 1404 accepts an input, the outputs are 180 degrees out of phase, allowing for a single axis monopulse operation of antenna 300, according to an exemplary embodiment. Ports 1606, 1608 may output the signal to be sent and split throughout feed 306.

Figure 17:
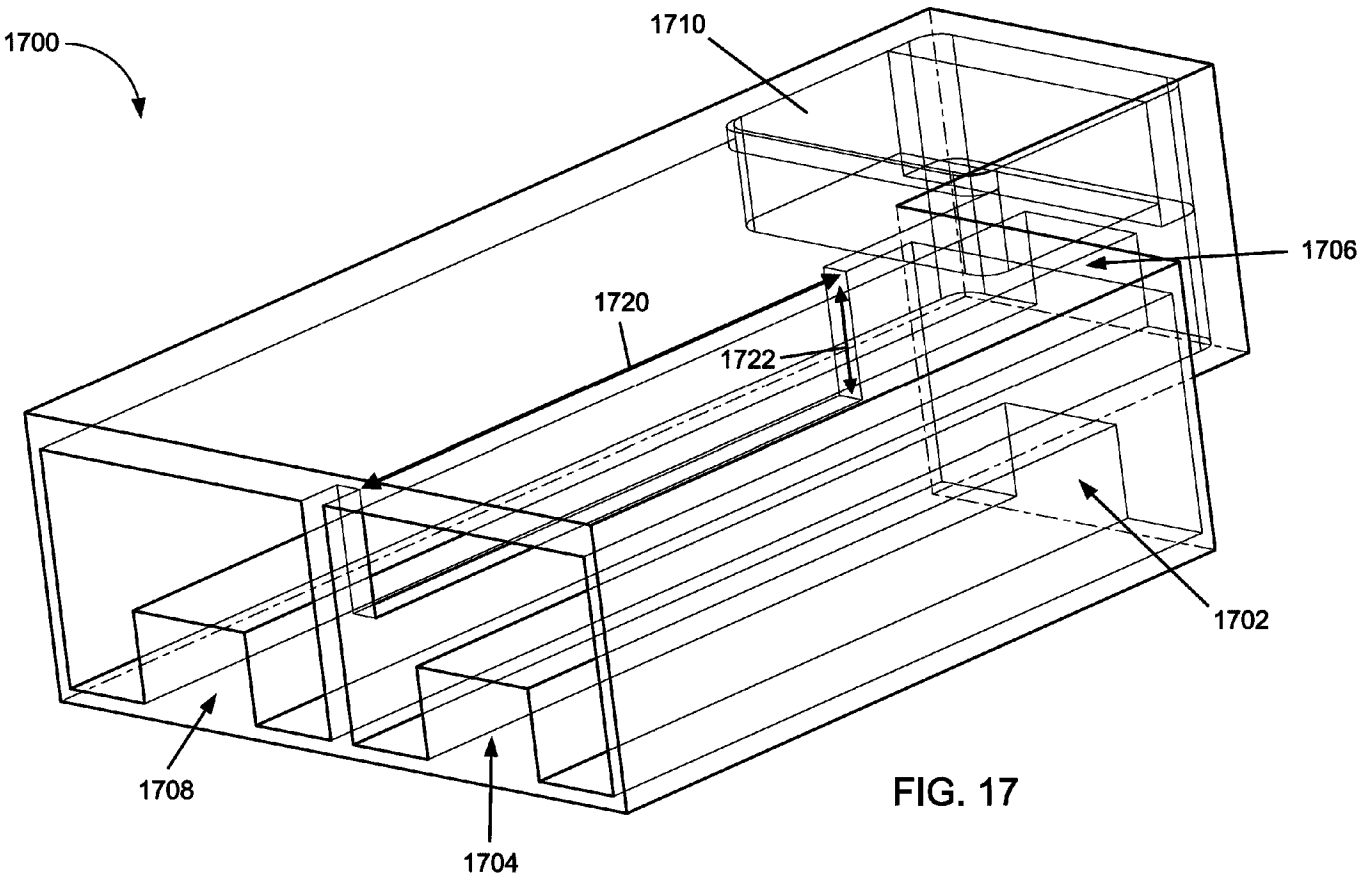
FIG. 17 is a perspective wire frame view of a hybrid coupler of the feed of FIG. 15A, according to an exemplary embodiment.

Referring to FIG. 17, a hybrid coupler 1700 is shown, according to an exemplary embodiment. Coupler 1700 may be compact with high power and low loss, with a high output isolation between ports 1704 and 1708 and a wide range of coupling ratios (0 dB to 3 dB) provided by common narrow wall slots 1720, 1722. Coupler 1700 has four ports 1702-1708. Waveguide load 1710 is used to terminate port 1706, which is isolated from port 1702.

Hybrid coupler 1700 is used to either split or combine the RF signal to be transmitted or received, according to an exemplary embodiment. Port 1702 may be provided an input signal. The signal is split at a specific ratio determined by the depth 1722 and length 1720 of the coupling slot in the common wall of the two ridge waveguides of coupler 1700. According to an exemplary embodiment, the ratio of the split signal may be a function of length 1720 and depth 1722. Ports 1704, 1708 may provide an output for the two portions of the split signal, and the phase of port 1708 is −90 degrees with respect to the phase of port 1704 (allowing the two signals to be output in different directions). According to an exemplary embodiment, coupler 1700 may provide inherit isolation between ports 1704 and 1708. Coupler 1700 may additionally combine two signals together. For combining, an opening in the sidewall of a ridge waveguide of coupler 1700 may be used to accept the two signals and to combine the signals together.

According to one exemplary embodiment, there may be 34 hybrid couplers 1700 in feed 306, allowing for 34 splits (even or uneven splits) of the input signal. Feed 306 may include 18 of the 34 hybrid couplers 1800 at the "end" of feed 306, allowing feed 306 to provide 36 outputs to transition 1410.

There is a 90 degree difference in the output signals of coupler 1700 that may be corrected for in phase shifters 308, according to an exemplary embodiment.

Referring to the construction and assembly of coupler 1700, the waveguide ridge, bottom wall, and side walls (including the slots) of the coupler may be machined from a single piece of aluminum, according to an exemplary embodiment. The top wall may be stamped or machined and staked to the bottom section and dip brazed together. Load 1710 is inserted from the top of coupler 1700 and glued into place.

Figure 18A:
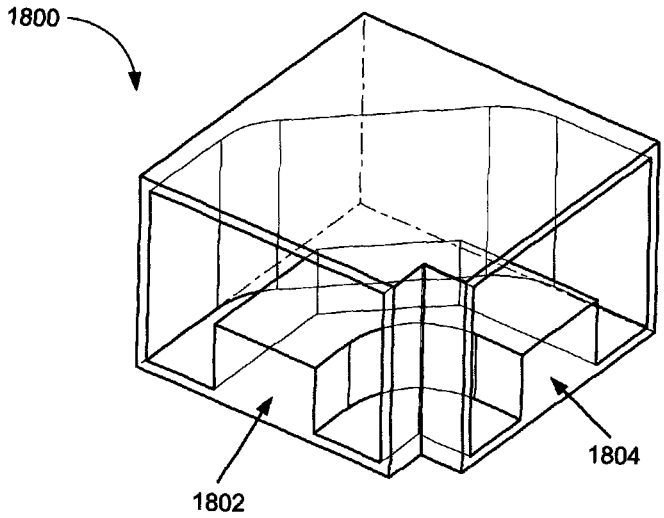
FIGS. 18A and 18B are perspective wire frame views of a bend of the feed of FIG. 15A, according to an exemplary embodiment.
Figure 18B:
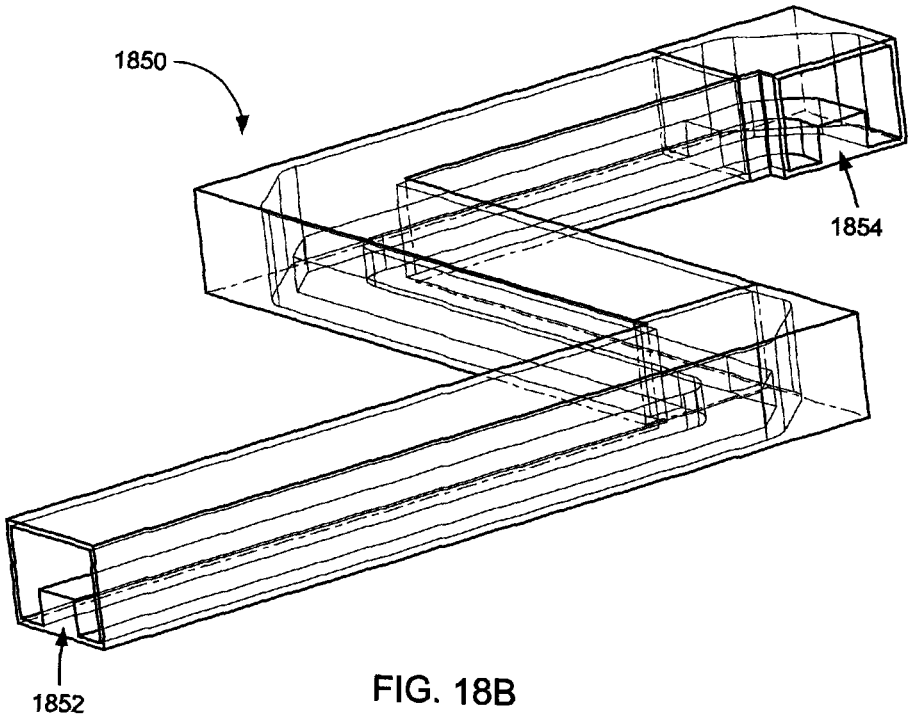

Referring to FIGS. 18A-B, bends 1800, 1850 with input ports 1802, 1852 and output ports 1804, 1854 are shown, according to an exemplary embodiment. Bend 1800 may be a bend with one "turn", while bend 1850 illustrates multiple "turns" or bends. According to an exemplary embodiment, bends 1800, 1850 may be 90 degree bends (accepting an input signal and providing an output at a 90 degree angle compared to the input). In the embodiment of FIG. 18B, multiple 90 degree bends are connected together to form the structure. The function of bends 1800 and 1850 is to route signals from one location in feed 306 to another. For example, referring also to FIG. 15A, potential locations for a bend 1800 (and/or bend 1850) is illustrated. According to an exemplary embodiment, there may be 24 bends 1800 in feed 306.

Figure 19:
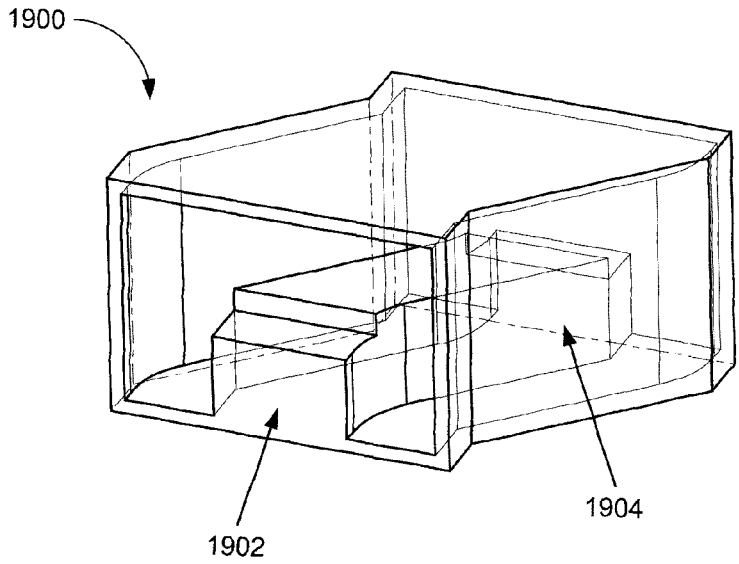
FIGS. 19 and 20 are perspective wire frame views of a routing structure of the feed of FIG. 15A, according to an exemplary embodiment.

Referring to FIG. 19, a routing structure 1900 with input port 1902 and output port 1904 is shown, according to an exemplary embodiment. The function of structure 1900 is to route signals from one location in the feed to another. According to one exemplary embodiment, there are sixteen such structures 1900 in the feed.

Figure 20:
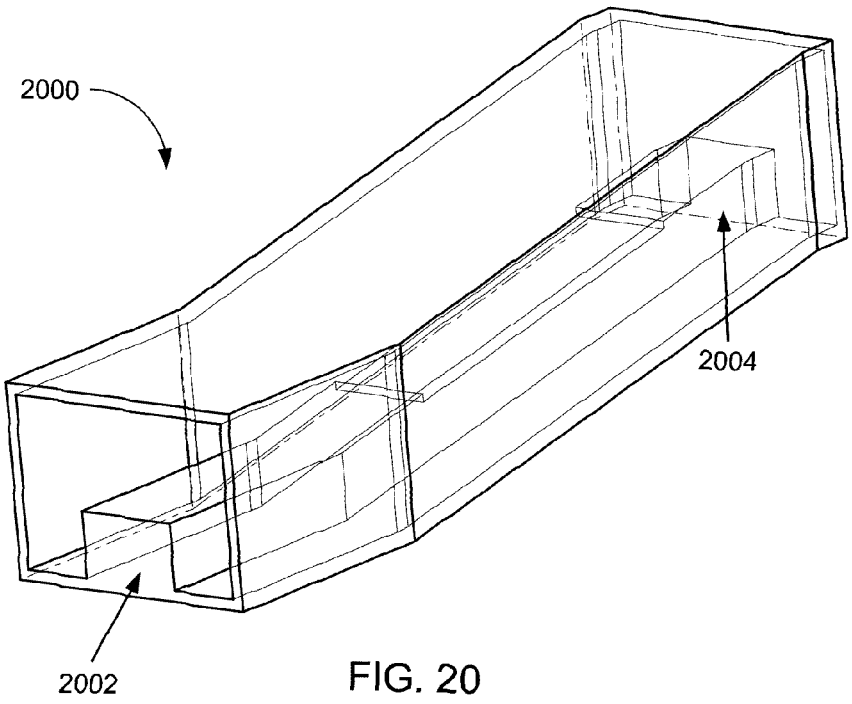

Referring to FIG. 20, another routing structure 2000 with input port 2002 and output port 2004 is shown, according to an exemplary embodiment. The function of structure 2000 is to route signals from one location in the feed to another. According to one exemplary embodiment, there are two such structures 2000 in the feed. Structures 1900, 2000 may be of different dimensions, according to an exemplary embodiment.

Feed 306 may be symmetric (e.g., the two "halves", a left half and right half, of feed 306 may be symmetric), according to an exemplary embodiment. The subcomponents of FIGS. 16-20 are used to form feed 306. According to one exemplary embodiment, half of feed 306 may be constructed and optimized by varying the coupling ratio of hybrid couplers 1700 via common wall slot length 1720 and width 1722 to achieve a desired amplitude taper for the signal. The signal may be routed between hybrid couplers 1700 using bends 1800, 1850 and structures 1900, 2000. The electrical lengths of connecting waveguide can be varied as well to achieve near modulo 90 degree phase at all outputs. The optimized half may be copied to construct the second half of feed 306, and both halves may be connected to splitter 1600.

Figure 21:
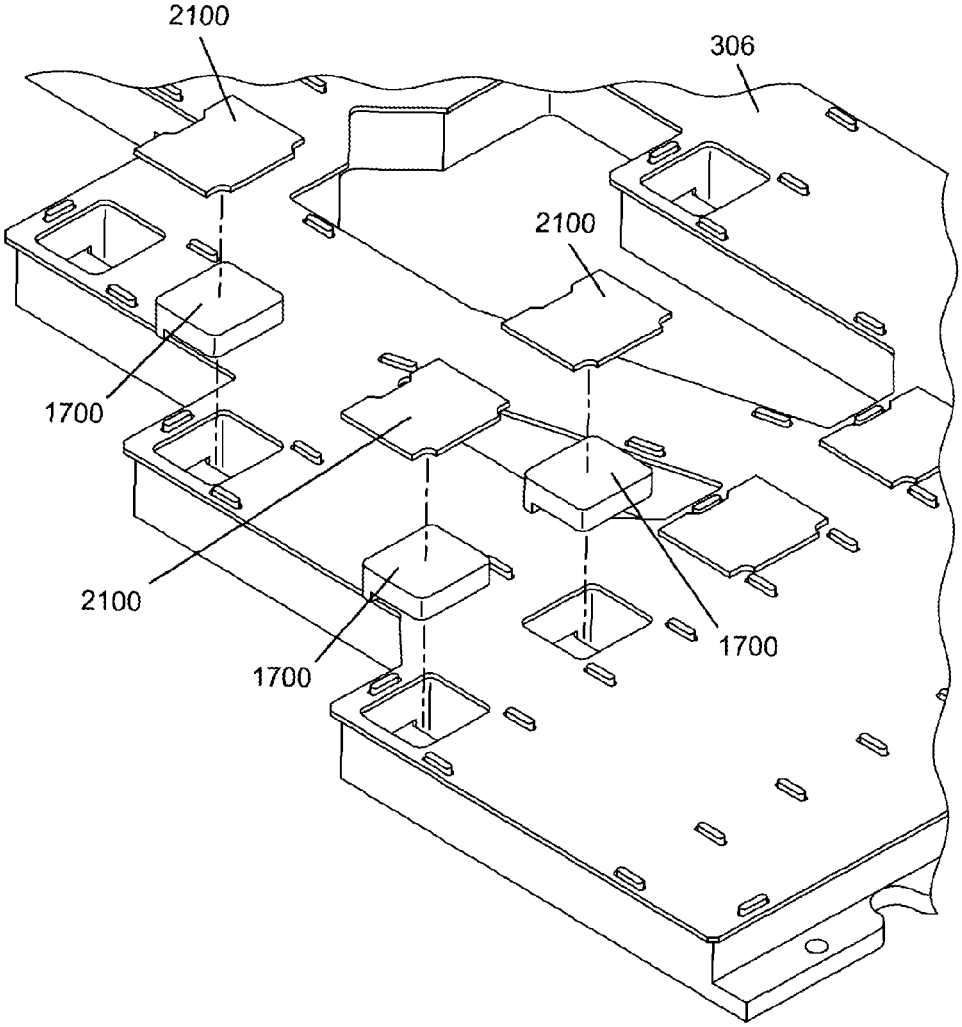
FIG. 21 is a view of a hybrid coupler to feed assembly, according to an exemplary embodiment.

Referring to FIG. 21, a hybrid coupler 1700 to feed 306 assembly is shown, according to an exemplary embodiment. Hybrid couplers 1700 are milled into the main portion 1506 of feed 306. The assembly may include covers 2100 to be placed over hybrid couplers 1700.

Referring back to FIG. 14, according to an exemplary embodiment, 18 couplers 1408 are shown at one end of feed 306 for providing multiple outputs. The 36 outputs of couplers 1408 are fed into multiple transitions 1410 (e.g., ridge waveguide transitions), which turn the output around in the opposite direction (e.g., a 180 degree transition). Transition 1410 couples to transition 1412 via phase shifters 308. Transition 1412 electrically couples aperture 302 and feed 306 of antenna 300 via slot coupler 1300. Transitions 1410, 1412 form a junction for propagating the received signal with low loss.

Figure 22A:
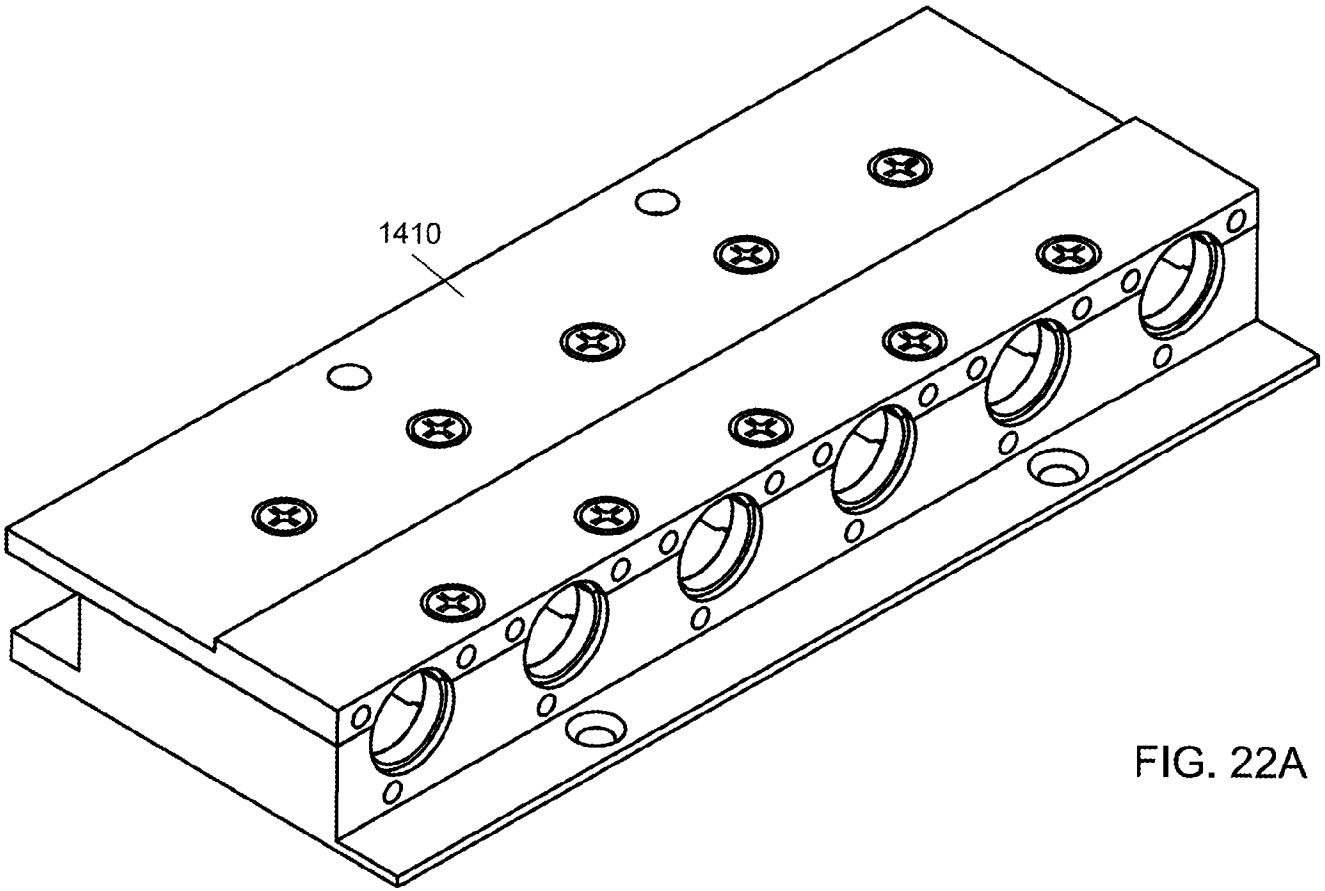
FIGS. 22A through 22D are views of a transition and the components of the transition of the antenna of FIG. 14, according to an exemplary embodiment.
Figure 22B:
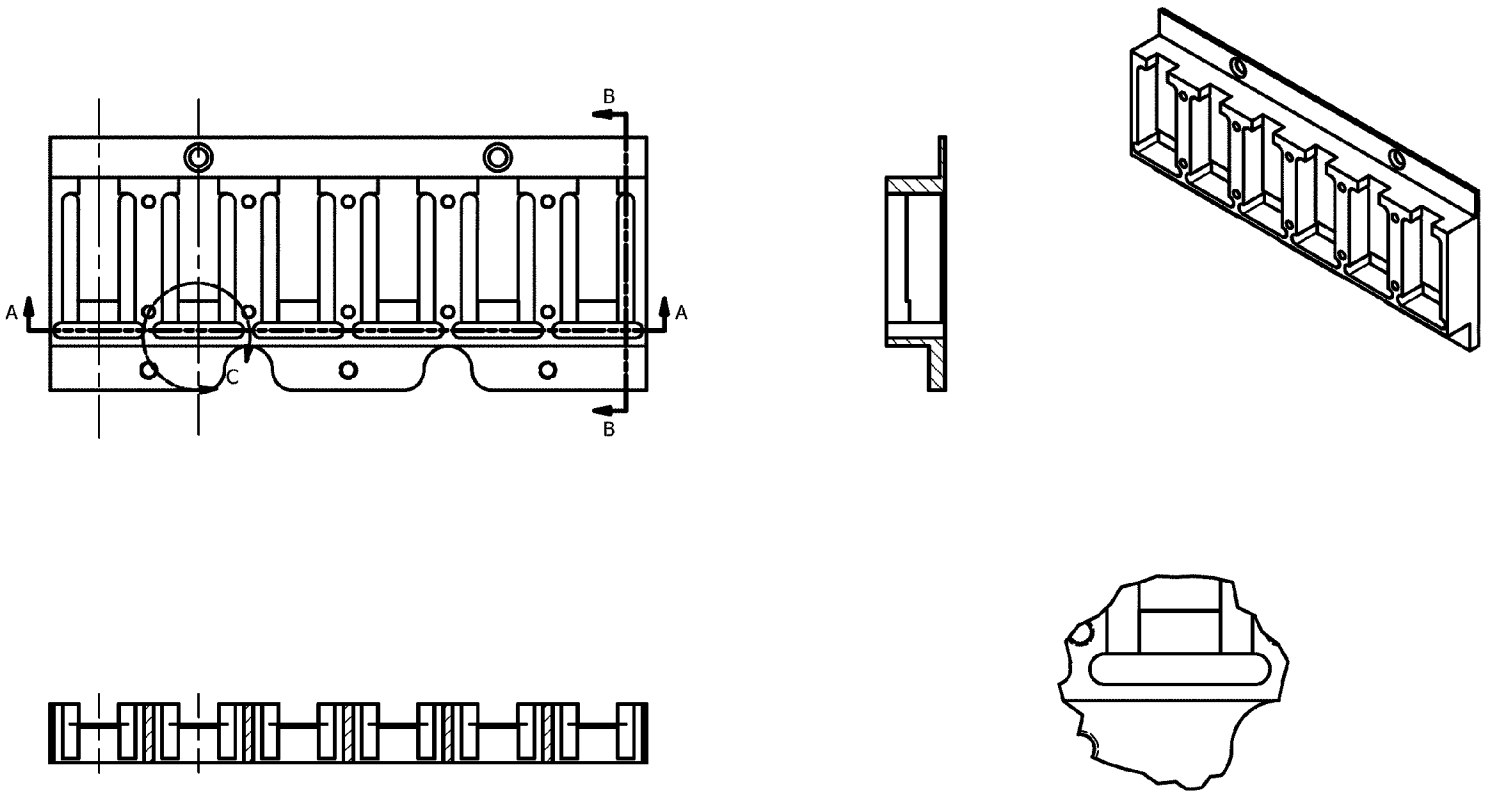
Figure 22C:
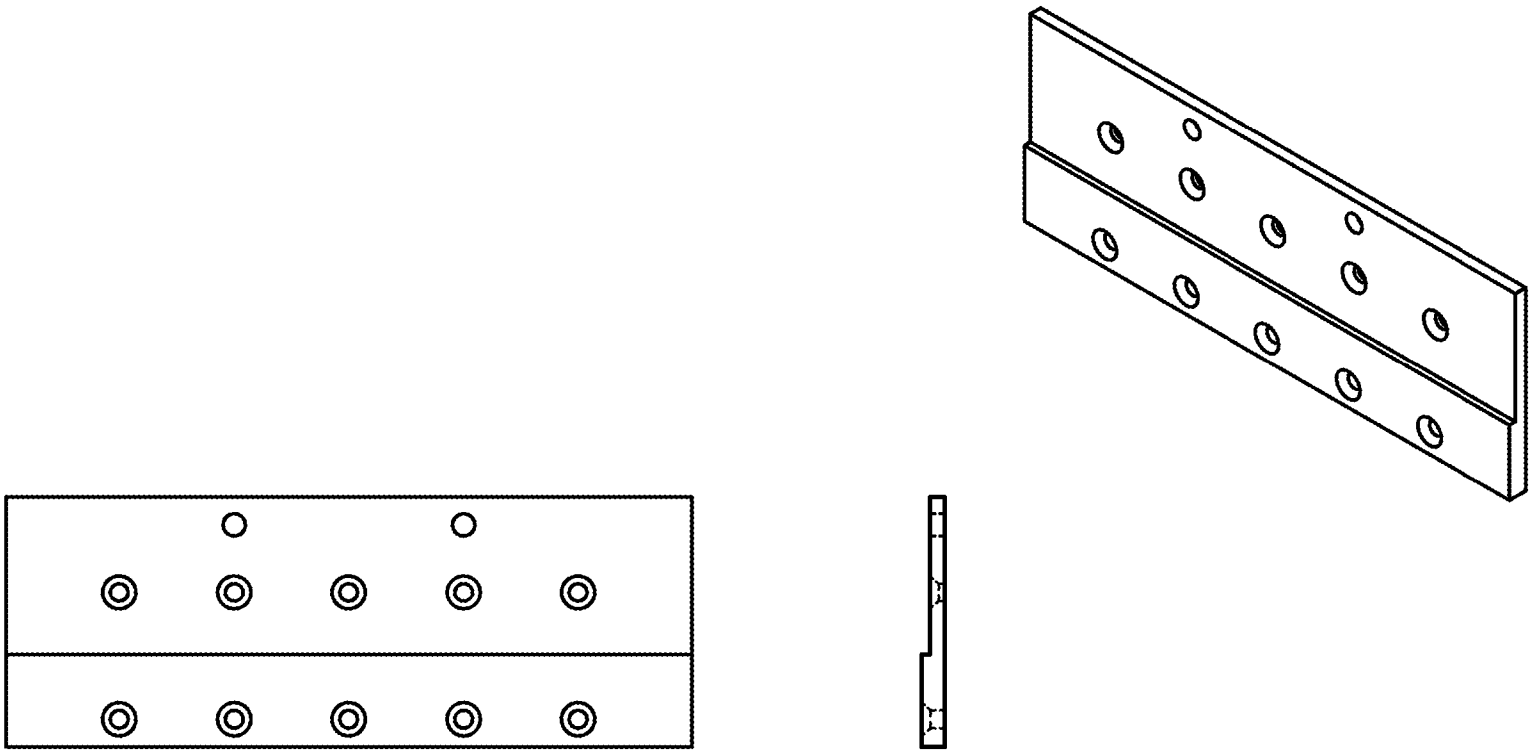
Figure 22D:
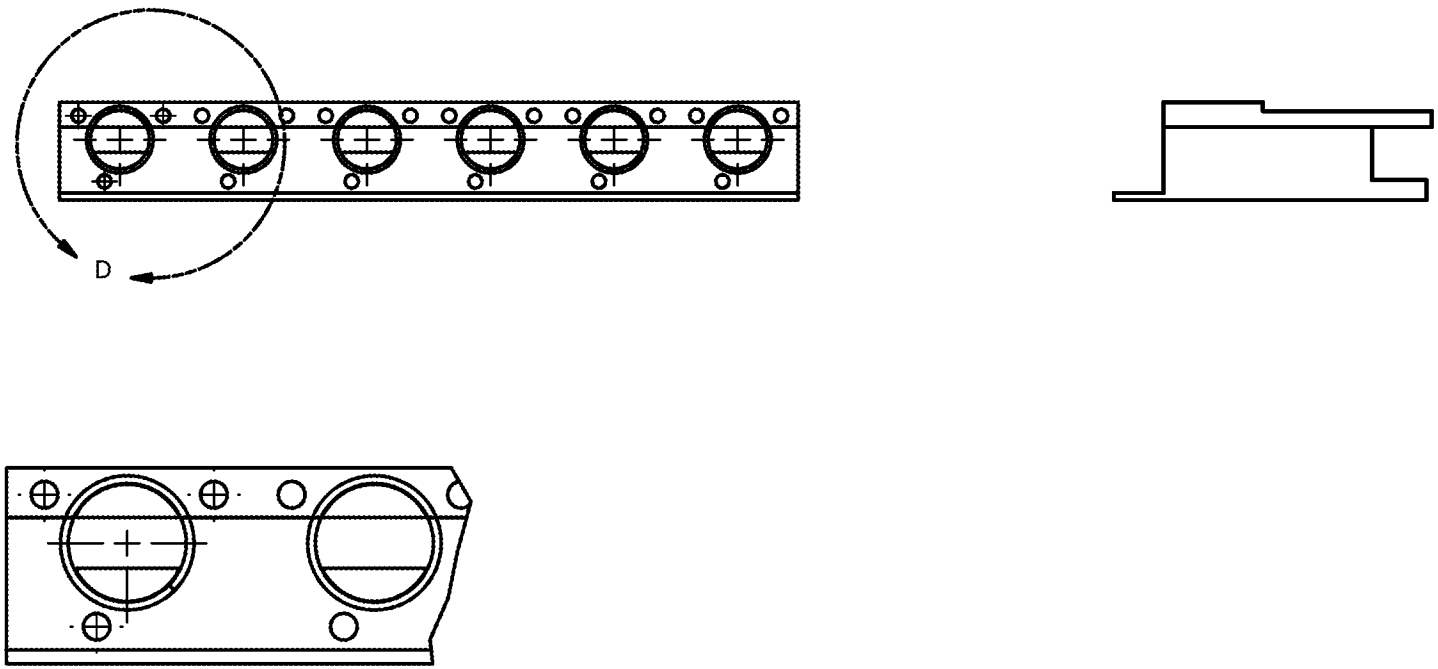
Figure 23:
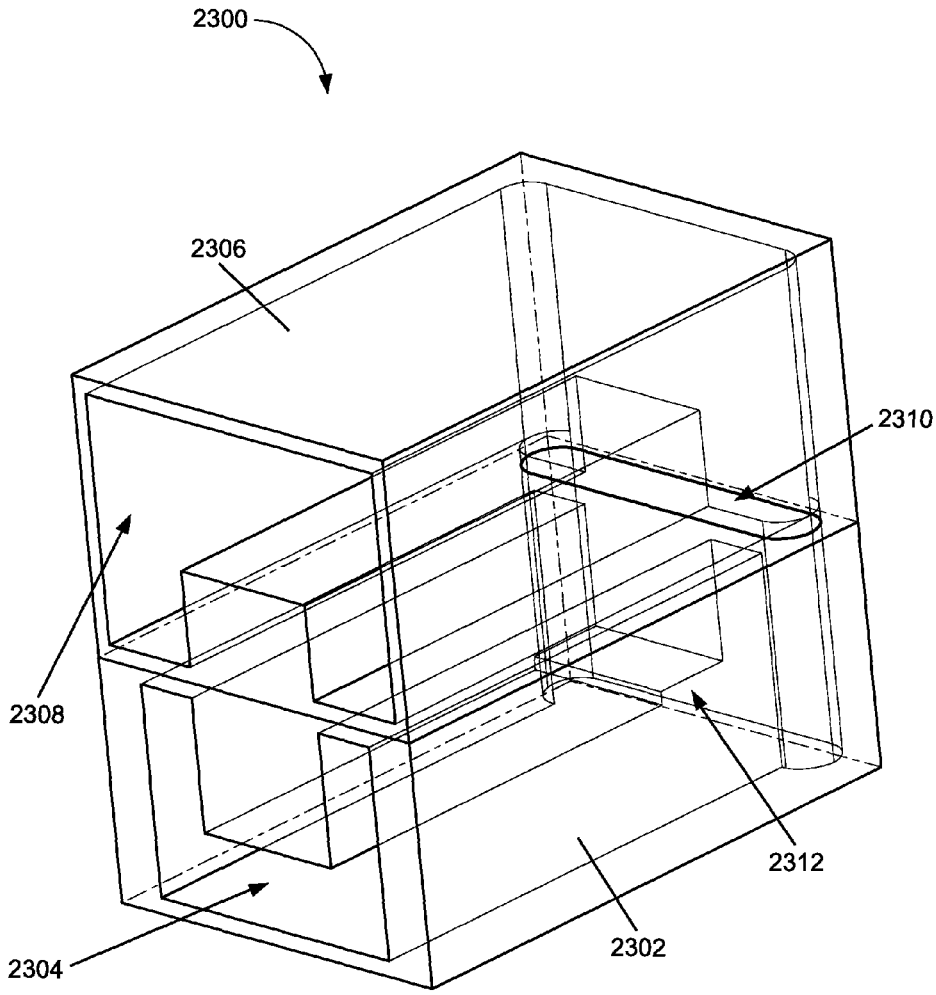
FIG. 23 is a wireframe view of a single component of the transition of FIGS. 22A-D, according to an exemplary embodiment.

Referring to FIGS. 22A-23, transitions 1410, 1412 are shown and described in greater detail. While one embodiment is shown, various embodiments of transitions 1410, 1412 are possible. For example, transition 1410 may be responsible for transitioning the input signal from feed 306 into phase shifters 308 while transition 1412 may be responsible for transitioning the input signal from phase shifters 308 into slot couplers 1300.

FIGS. 22A-D illustrate transition 1410 in further detail, according to an exemplary embodiment. FIGS. 22A-D further characterize transition an embodiment of transition 1410.

Referring to FIG. 23, a transition 2300 (e.g., a ridge waveguide transition) is shown, according to an exemplary embodiment. Transition 2300 may be generally configured to accept a signal traveling in a first direction and output the signal in a second direction. According to one embodiment, multiple transitions 2300 may be coupled together or otherwise be used in an antenna to redirect a signal. For example, multiple transitions 2300 may be used to form a general shape such as transition 1410 as shown in FIGS. 22A-D. In one embodiment, transition 2300 is a 180 degree transition where the second direction is opposite of the first direction. Transition 2300 may be configured to propagate the input signal with low loss, according to an exemplary embodiment.

Waveguide transition 2300 includes a first waveguide 2302 with a port 2304 and a second waveguide 2306 with a port 2308, along with a coupling slot 2310. Second waveguide 2306 may be parallel to first waveguide 2302. Transition 2300 may provide a redirection of an input signal, transitioning the input signal from first port 2304 heading in a first direction to second port 2308 heading in the opposite direction and vice versa. Transition 2300 may be configured to direct the RF signal up or down one "layer" (e.g., higher or lower in antenna 300).

Port 2304 of first waveguide 2302 may be provided with a signal. The signal travels down first waveguide 2302 and coupled through coupling slot 2310 at the end of first waveguide 2302 into second waveguide 2306. Coupling slot 2310 is used to propagate the signal from first waveguide 2302 to second waveguide 2306. The signal continues to propagate down second waveguide 2306. Compared to first waveguide 2302, there is a redirection in the direction of propagation (e.g., a 180 degree turn). Waveguide transition 2300 is reciprocal. First waveguide 2302 of waveguide transition 2300 includes an inductive step 2312 in the ridge for impedance matching between the two waveguides 2302, 2306.

Referring to the construction and assembly of transition 2300, first waveguide 2302 may be machined and dip brazed as part of the larger feed 306, according to an exemplary embodiment. Second waveguide 2306 may be separately machined and dip brazed and later attached to first waveguide 2302 using screws, according to an exemplary embodiment.

According to one exemplary embodiment, there are 36 transitions 2300 in feed 306. With reference to transition 1410 of FIG. 14, first waveguide 2302 carries receives a signal from the 18 hybrid couplers 1700 at the output end of feed 306 in a first direction. Second waveguide 2306 outputs the signal in a second direction (opposite of the first direction) to aperture 302 via phase shifters 308, transition 1412, and slot coupler 1300. Second waveguide 2306 includes a ridge.

While the detailed drawings, specific examples, detailed algorithms, and particular configurations given describe preferred and exemplary embodiments, they serve the purpose of illustration only. The inventions disclosed are not limited to the specific forms shown. For example, the methods may be performed in any of a variety of sequence of steps or according to any of a variety of mathematical formulas. The hardware and software configurations shown and described may differ depending on the chosen performance characteristics and physical characteristics of the radar and processing devices. For example, the type of system components and their interconnections may differ. The systems and methods depicted and described are not limited to the precise details and conditions disclosed. The specific data types and operations are shown in a non-limiting fashion. Furthermore, other substitutions, modifications, changes, and omissions may be made in the design, operating conditions, and arrangement of the exemplary embodiments without departing from the scope of the invention as expressed in the appended claims.

What is claimed is:

1. An apparatus for electrically coupling a ridge waveguide on a first layer of a feed to a ridge waveguide on a second layer of a feed of an antenna, the apparatus comprising:

a first ridge waveguide having an input end and an output end, a first cross-section and impedance, and configured to receive a signal from a first direction;

a second ridge waveguide having an input end and an output end, a second cross-section and impedance, substantially parallel to the first waveguide and configured to output the signal in a second direction; and a coupling slot located at the output end of the first ridge waveguide and the input end of the second ridge waveguide for propagating the signal from the first ridge waveguide to the second ridge waveguide, wherein a ridge of the first ridge waveguide comprises a step to match the impedance of the second ridge waveguide with the impedance of the first ridge waveguide.

2. The apparatus of claim 1, wherein the second direction is opposite the first direction.

3. The apparatus of claim 1, wherein the apparatus is a junction propagating the signal with low loss.

4. The apparatus of claim 1, wherein the apparatus propagates the signal from a feed manifold to an aperture through a phase shifter, a transition, and a slot coupler.

5. The apparatus of claim 1, wherein the antenna is a radar system antenna.

* * * * *